US006030131A

United States Patent [19]

Shimamura et al.

[11] Patent Number: 6,030,131

[45] Date of Patent: Feb. 29, 2000

[54] PHOTOGRAPHIC FILM PROCESSING APPARATUS INCLUDING A FILM SUPPLYING APPARATUS IN FILM DEVELOPING SYSTEM

[75] Inventors: Yasunobu Shimamura; Junichi Miyai; Kazunori Tsumura; Atsuhiko Yamada, all of Wakayama, Japan

[73] Assignee: Noritsu Koki Co., Ltd., Wakayama, Japan

[21] Appl. No.: 09/075,173

[22] Filed: May 11, 1998

[30] Foreign Application Priority Data

| | | | |
|---|---|---|---|
| May 9, 1997 | [JP] | Japan | 9-119857 |
| Nov. 4, 1997 | [JP] | Japan | 9-301682 |
| Mar. 6, 1998 | [JP] | Japan | 10-055340 |

[51] Int. Cl.[7] ..... G03D 13/08; G03D 17/00

[52] U.S. Cl. ..... 396/599; 396/613; 396/646; 396/651; 396/652; 396/620

[58] Field of Search ..... 396/598, 599, 396/603, 612, 613, 620, 646, 651, 652

[56] References Cited

U.S. PATENT DOCUMENTS

| | | | |
|---|---|---|---|
| 5,463,441 | 10/1995 | Yamaguchi | 396/646 |
| 5,483,317 | 1/1996 | Tanibata | 396/646 |
| 5,561,489 | 10/1996 | Yamaguchi et al. | 396/612 |
| 5,579,074 | 11/1996 | Knecht et al. | 396/646 |
| 5,708,906 | 1/1998 | Hashizume | 396/613 |
| 5,796,465 | 8/1998 | Arimoto et al. | 396/613 |

*Primary Examiner*—D. Rutledge
*Attorney, Agent, or Firm*—Smith Patent Office

[57] ABSTRACT

A film developing process automatically conveys film to a film developing section. When a cartridge conveyed intermittently by a cartridge conveying device is conveyed to a first stop position, a tapered tongue drawing device is actuated to draw an end portion of a film strip out of the cartridge. At a second stop position, a cutting device and a punching device are operated to cut the tapered tongue and form coupling holes on the end portion of the film strip respectively. At a third stop position, a reinforcing label is applied to the end portion of the film strip by a label sticking device. At fourth and fifth stop positions, the end portions of the film strips are coupled with a leader sheet which has been conveyed and stopped at the other side of the fourth and fifth stop positions. The cartridges are then conveyed together with the leader sheet into the film developing section. Between the film developing section and the printing section a leader sheet guide is installed in which is formed a leader sheet guide path. A leader sheet sent out from the film developing section is sent into a leader sheet supporter and when the leader sheet stops, the leader sheet and film strips are released from their coupling. The leader sheet guide is then moved to second and third stop positions where the film strips are sent into a film path of the printing section.

9 Claims, 20 Drawing Sheets

S1
S4
S5
20
21
22
23
30
31
32
33
34
35
36
37
40
41
42
43
50
51
52
53
54
55
56
130
131
132
P
C
c
b
d
e
f
F

PHOTOGRAPHIC FILM PROCESSING APPARATUS INCLUDING A FILM SUPPLYING APPARATUS IN FILM DEVELOPING SYSTEM

BACKGROUND OF THE INVENTION

1. Field of the Invention

The present invention relates to a film supplying apparatus in a film developing system of a leader sheet conveying type. The present invention also relates to a photographic film processing apparatus for automatically implementing a series of processes comprising developing the photographic film strip, printing an image from a developed film onto photographic printing paper, and developing the photographic printing paper.

2. Discussion of the Related Art

Generally, when an undeveloped film strip wound in a cartridge is developed in a film developing system of a leader sheet conveying type, a tapered tongue end portion of the film strip is drawn out of the cartridge to be cut off, and, after a leader sheet is coupled with the end portion of the film strip, the film strip with the leader sheet in front is transported to a film developing section.

The leader sheet is made of a flexible plastic sheet and has a row of perforations for feeding the leader sheet. Each leader sheet is formed with the perforations at equal intervals and they are engageable with sprockets in the film developing section.

The leader sheet is generally coupled with the film strip by sticking a splicing tape on the film strip and the leader sheet. But the splicing tape demands time to attach it and time to peel it off after the film is developed. Further the tape presents an additional inconvenience in that a special working table is necessary for coupling the film strip to the leader sheet because the film strip must be precisely connected to a predetermined position of the leader sheet. Another problem is that the splicing tape is not economical because the tape can not be used repeatedly.

To solve the problems mentioned above, the assignee of the present invention has already proposed a coupling structure for a leader sheet and a film strip as shown in FIG. 15 (related to Japanese Patent Application No. 230253 of 1995).

In the coupling structure a first insert slot 1 and a second insert slot 2 are formed on a leader sheet L. The leader sheet L has a row of perforations h for feeding the leader sheet. A coupler tongue 3 is formed so as to extend across a first insert slot 1 in the transporting direction of the leader sheet. The front end portion of the coupler tongue 3 is located over one side of the slot 1 and the rear end portion of the coupler tongue 3 is supported by a peripheral portion of the first insert slot 1. The end portion of the film strip F is inserted through a second insert slot 2 into the first insert slot 1 and thereby the coupler tongue 3 engages a coupling hole 4 arranged at the end portion of the film strip F.

In the coupling structure for the leader sheet and the film strip, the film strip is allowed to be easily and firmly connected to the leader sheet at a predetermined position.

Heretofore is also well known to use a photographic film processing apparatus in which a photographic film is developed in a film developing section, and the developed film is sent into a printing section located next to the film developing section. The images in the developed film are then printed onto photographic printing paper and the photographic printing paper is then developed.

When the photographic film is developed in the photographic film processing apparatus mentioned above, the photographic film may be coupled to flexible leader sheet and led and conveyed by the leader sheet through the film developing section to be developed. On the other hand, in the printing process, only the developed negative film is sent into the printing section for print processing.

Therefore between the developing section and the printing section, the photographic film is separated from the leader sheet and only then is the film strip sent into the printing section.

SUMMARY OF THE INVENTION

In a film developing process using a leader sheet L of the film-hooking type, if such preparative works such as drawing out the tapered tongue of film, cutting the tapered tongue, punching the holes in the film, and coupling the film with the leader sheet, are carried out manually, they demand a large amount of labor. Further these processes require equipment such as a tapered tongue drawing device, a tapered tongue cutting device and a splicing device to couple the film strip with the leader sheet, resulting in an economical problem.

There also is a risk that once the leader sheet is coupled with the film strip, the film strip might be drawn out of the cartridge at a stage when the leader sheet is placed in the film developing apparatus.

An object of the present invention is to provide a film supplying apparatus in a film developing system wherein a cartridge containing a film strip therein is simply placed into the film supplying apparatus and is automatically conveyed together with a leader sheet to a film developing section.

To solve the problems mentioned above, the invention employs a construction comprising a film supplying section arranged at an entrance side of a film developing section, a cartridge conveying device which receives a cartridge inserted into the film supplying section and conveys it to a leader sheet coupling position, a leader sheet supplying device for supplying a leader sheet to the leader sheet coupling position, a splicing device which, at the leader sheet coupling position, splices the end portion of the film strip drawn out of the cartridge with the leader sheet, and a leader sheet conveying device for conveying the spliced leader sheet together with the cartridge to the film developing section.

Regarding a cartridge to be inserted into the film supplying section, preparative works such as drawing out the end portion of the film strip in the cartridge and cutting the tapered tongue finished before the film strip is coupled with the leader sheet. To couple a film strip with the leader sheet, either the hook-type coupling or that with a splice tape may be employed.

A further aspect of the invention employs a similar construction to that described above and further comprises a cutting device and a punching device. Prior to coupling the film strip with the leader sheet, the cutting device cuts off the tapered tongue formed on the end portion of the film strip and the punching device punches out coupling holes on the end portion of the film strip whose tapered tongue has been removed.

Further, another aspect of the invention further comprises a tapered tongue drawing device wherein the tapered tongue formed on the end portion of the film strip is drawn out of the cartridge before the tapered tongue of the film strip is cut off.

Another embodiment of the invention employs a construction comprising a film supplying section arranged at an entrance side of a film developing section; a cartridge conveying device which receives a cartridge inserted into the film supplying section and intermittently conveys it; a tapered tongue drawing device which, at a stop position where the cartridge conveyed by the cartridge conveying device stops, draws out a tapered tongue formed on an end portion of a film strip wound inside the cartridge; a cutting device and a punching device, wherein the cutting device cuts off the tapered tongue and the punching device punches out coupling holes on the end portion of the film strip at another cartridge stop position located downstream from the tapered tongue drawing device; a label sticking device for attaching a reinforcing label on the end portion of the film strip whose tapered tongue has been cut off; a leader sheet supplying device for supplying a leader sheet to another cartridge stop position located downstream from the label sticking device; a splicing device which draws the film strip out of the cartridge, inserts the film strip into an insert slot formed on the leader sheet, and makes the coupler tongues formed to traverse the insert slot engage with coupling holes in the film strip; and a leader sheet conveying device which conveys the spliced leader sheet together with the cartridge to the film developing section.

Conventional photographic film processing apparatuses have a problem of insufficient processing capacity since they employ a single array processing system in which a single roll of film is coupled with a leader sheet.

A further object of the present invention is to provide a photographic film processing apparatus for processing photographic film more efficiently.

To solve the capacity problem mentioned above, the present invention also employs a structure where a photographic film processing apparatus uses a leader sheet for conveying a film strip. The leader sheet is formed with a plurality of insert slots on the trailing end thereof with respect to the conveying direction. In each of the insert slots, a front end of a film strip is inserted to be coupled with the leader sheet by inserting a flexible coupler tongue, provided so as to traverse each insert slot, into a coupling hole formed on the front end of the film strip. The film strip is then sent into a film developing section led by the leader sheet. Only the developed film is sent into a printing section next to the developing section to print the images onto a photographic printing paper and then develop them. The apparatus includes a leader sheet guide installed between the film developing section and the printing section. A leader sheet guide shifter is also provided for moving the leader sheet guide from a position where a leader sheet guide path formed on the leader sheet guide faces an exit port of the film developing section to each position where each front end of plurality of film strips left on the leader sheet guide path face an entrance port of a single film path provided in the printing section.

The leader sheet guide is equipped with a leader sheet feed roller for conveying the leader sheet sent into the leader sheet guide path and the film strips following the leader sheet. A plurality of film feed rollers are provided, each of which conveys each of a plurality of film strips and can be driven in both forward and reverse directions. The printing section is equipped with a uncoupling means for releasing the leader sheet and the film strip from their coupling therebetween when the leader sheet is sent out of the leader sheet guide.

Further, the present invention employs a structure in which an opening is provided between the leader sheet feed roller and the film feed roller of the leader sheet guide to allow a loop formed on the leader sheet to be inserted by stopping the film feed roller and rotating the leader sheet feed roller.

The uncoupling means has a uncoupling arm which is installed so as to be swung upwardly and downwardly under the leader sheet sent into the printing section. When the uncoupling arm is swung upward, a tip thereof is inserted into the coupling hole formed on the leader sheet to release the coupler tongue and the coupling hole from their coupling therebetween by deforming the front end of the film strip upwardly.

Other characteristic features and effects of the present invention will become obvious by the description of the embodiments below with reference to the drawings.

BRIEF DESCRIPTION OF THE DRAWINGS

The above and other objects and features of the present invention will be clearly understood from the following description with respect to preferred embodiments thereof when considered in conjunction with the accompanying drawings, wherein the same reference numerals have been used to denote the same or similar parts or elements, and in which.

DETAILED DESCRIPTION OF THE PREFERRED EMBODIMENTS

Figure 1:
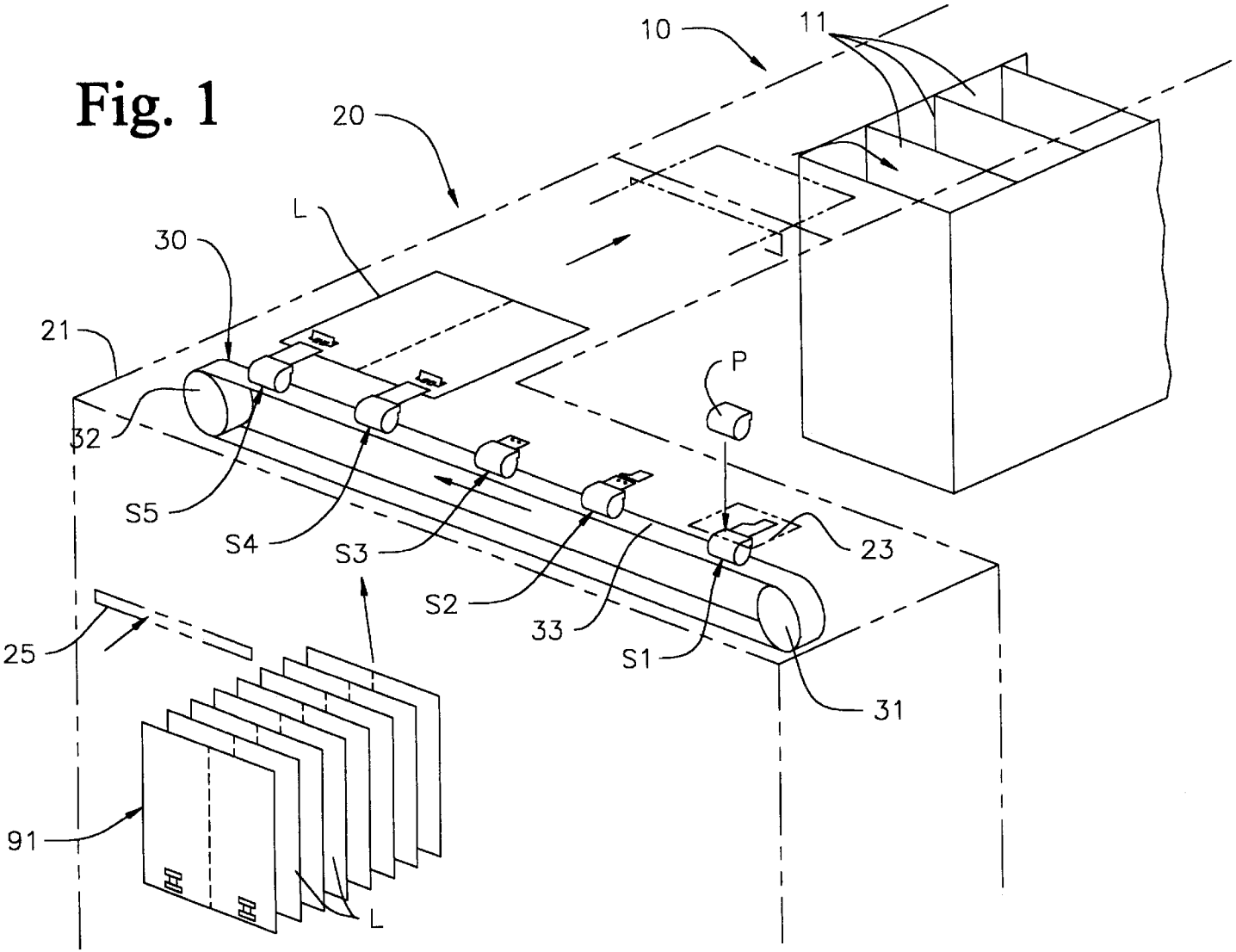
FIG. 1 is a schematic view of the first embodiment of the present invention.
Figure 2:
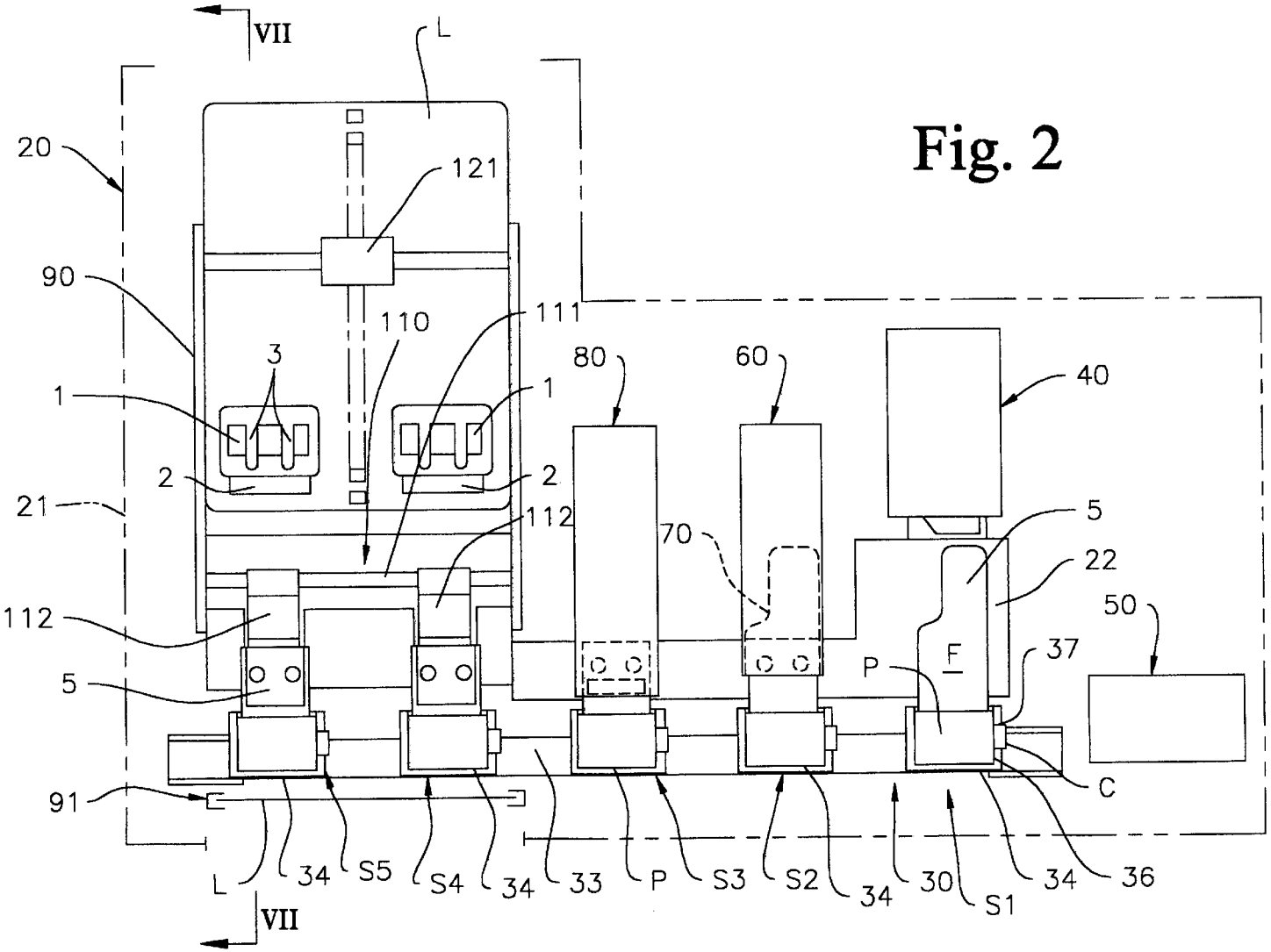
FIG. 2 is a cross sectional view of FIG. 1.

As shown in FIGS. 1 and 2, a film developing section 10 has a plurality of developer tanks 11 arranged in a row for developing a film strip. The film strip is developed while passing through the solution in the developer tanks 11.

A film supplying section 20 is arranged at the entrance side of the film developing section 10. The film supplying section 20 has a casing 21 and a table 22 therein.

The table 22 extends in a direction normal to the direction along which the developer tanks 11 are arranged in the film developing section 10. At a side portion of the table 22 is arranged a cartridge conveying device 30 to pass a cartridge P along the table 22.

As shown in FIG. 4, the cartridge P is equipped with a spool "c" for rewinding a film strip in a case "a" having a film passage opening "b". Both ends of the spool "c" pass through the end plates "d" of the case "a" and one end extends out of the case "a". Engaging holes "e" are arranged at both end faces of the spool "c".

Figures 3A, 3B, 3C:
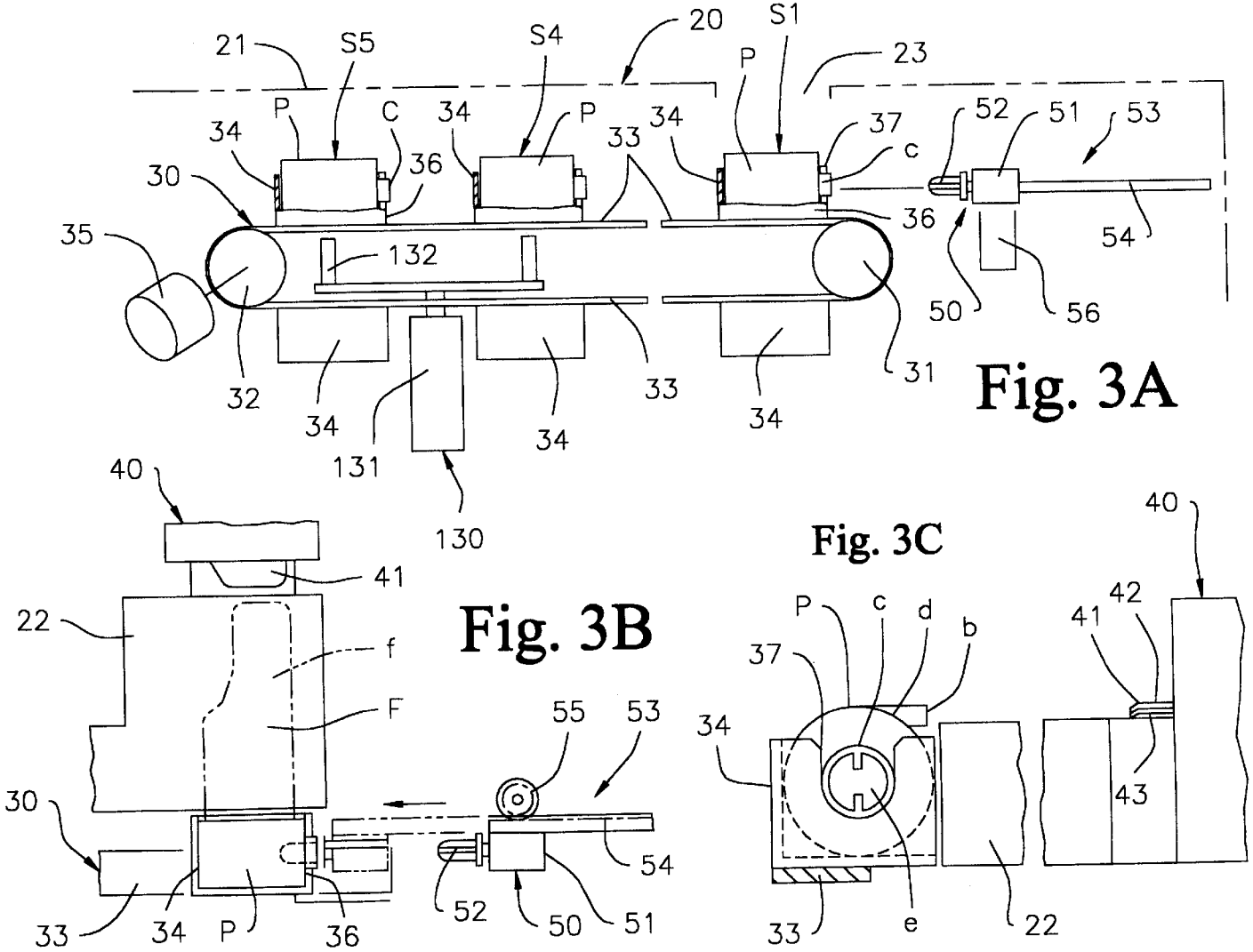
FIGS. 3A, 3B, and 3C are respectively a front view of the cartridge conveying device, a plan view thereof at the first stop position, and a side view.

As shown in FIG. 3A, a cartridge conveying device 30 has an endless belt 33 arranged between a pair of pulleys 31, 32 and a plurality of cartridge holders 34 are installed on the belt 33 keeping equal intervals therebetween.

Further, one pulley 32 of the pair of pulleys is connected to a motor 35. The motor 35 moves the belt 33 in the direction shown by an arrow in FIG. 3A, by a stroke equal to the distance between cartridge holders 34.

Figure 15:
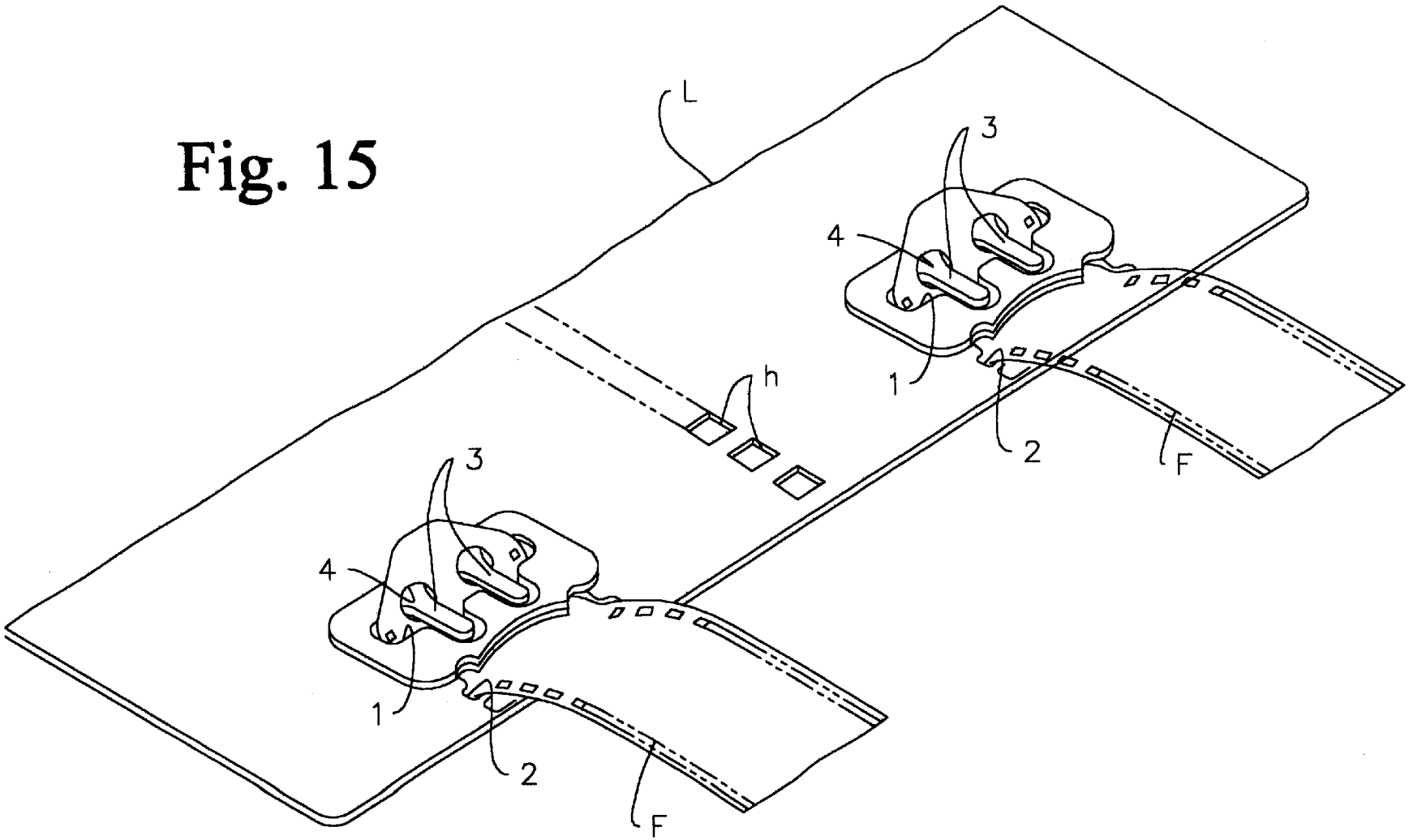
FIG. 15 is a perspective view of a coupling condition of the leader sheet and the film strips.

The space between the cartridge holders 34 is equal to the interval between a pair of first insert slots 1 of the leader sheet L as shown in FIG. 15.

The cartridge holder 34 is an open box shape with open surfaces on the top and one side facing the table 22. At the upper edge of one of the end plates 36 of the holder is arranged a notch 37 to support one end of the spool "c" of the cartridge P.

Regarding stop positions for a cartridge holder 34 intermittently conveyed through the movement of the belt 33, the first through the fifth stop positions S1 to S5 are arranged in order from one end. At one side of the first stop position S1 is arranged a tapered tongue drawing device 40 for drawing out a tapered tongue "f" formed on an end portion of a film strip F inside a cartridge holder 34 onto the table 22.

A rotating device 50 for rotating the spool "c" of the cartridge P is arranged at a position located opposite the cartridge conveying direction and is spaced apart from the first stop position S1 where the cartridge holder 34 stops.

Figure 4A:
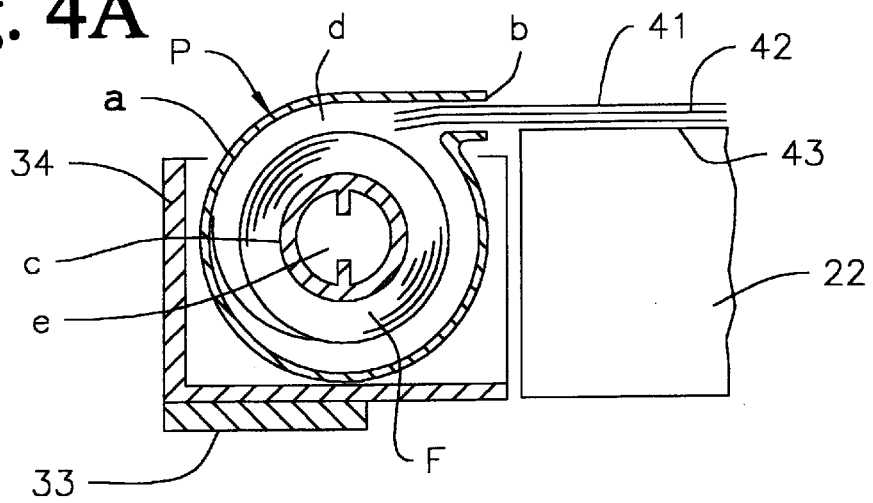
FIGS. 4A, 4B and 4C are schematic views indicating each step of the tapered tongue drawing process respectively.

The tapered tongue drawing device 40 will only briefly be described with reference to FIGS. 4A, 4B and 4C because it has been disclosed in Japanese Utility Model Laid-Open Publication No. 52854 of 1993. The tapered tongue drawing device comprises first to third drawing plates 41, 42, 43 made of a material such as a thin metal plate. To draw out a tapered tongue, each of three tapered tongue drawing plates 41, 42, 43 are moved in the longitudinal direction so that each tip of the blade is inserted into the film passage opening "b" of the cartridge P as shown in FIG. 4A.

Figure 4B:
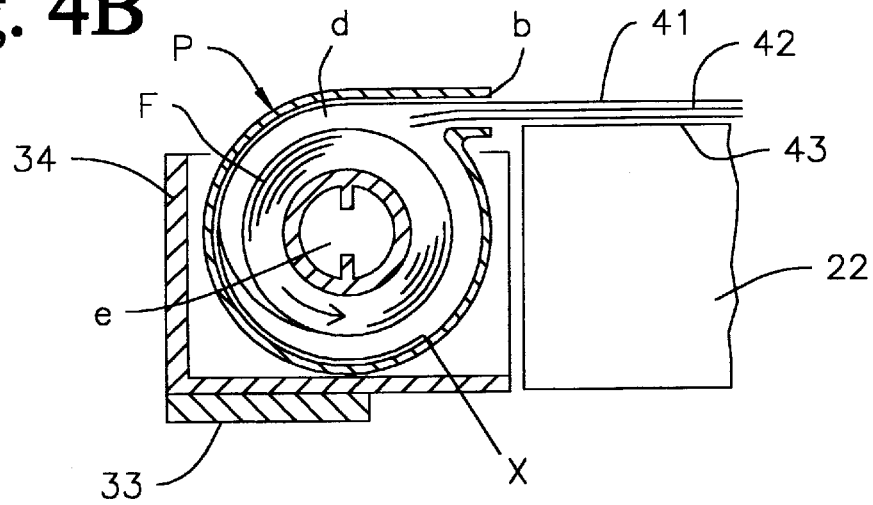

Then, the first tapered tongue drawing plate 41 on the top is moved longitudinally until its tip reaches a position X as shown in FIG. 4B. Then, the rotating device 50 drives and rotates the spool "c" in the direction shown by an arrow in FIG. 4B. It stops when the tip of the film strip F passes over the tips of the second and the third tapered tongue drawing plates 42, 43. A sound sensor, not shown, detects a hitting sound produced when the tip of the film strip elastically hits the first tapered tongue drawing plate 41.

Figure 4C:
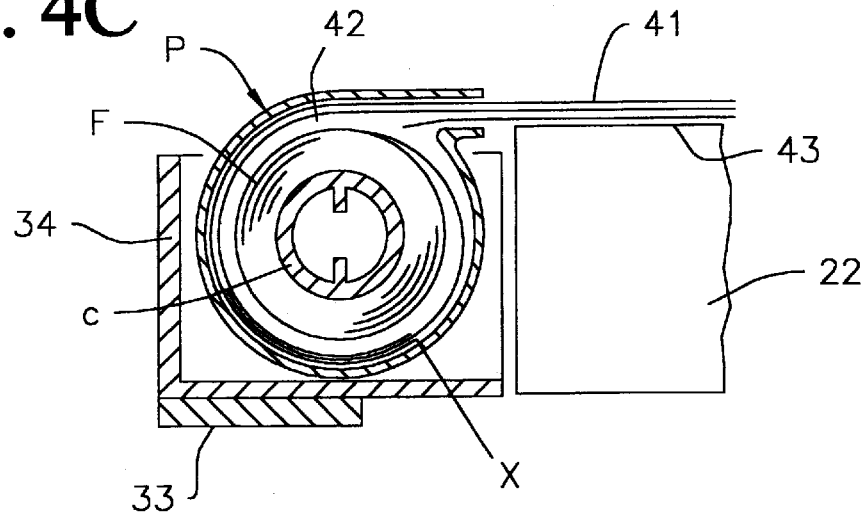

After rotation of the spool "c" has stopped, the second tapered tongue drawing plate 42 is moved longitudinally so as to pass into the inner side of the end portion of the film strip F until the tip of the second tapered tongue drawing plate reaches up to the position X as marked in FIG. 4C, then the second tapered tongue drawing plate 42 is stopped.

Following the above steps, the first, second and third tapered tongue drawing plates 41, 42, 43 are drawn back so that the tapered tongue "f" of the end portion of the film strip F is pinched between the first and the second tapered tongue drawing plates 41, 42 and is drawn out of the cartridge P.

As shown in FIG. 3, the rotating device 50 has a motor 51 whose rotating shaft is equipped with an engaging shaft 52 capable of engaging with an coupling hole "e" of the spool "c", so that the motor 51 may be shifted back and forth by a moving device 53 with respect to the cartridge holder 34 which has been stopped at the first stop position S1.

In the moving device 53, the motor 51 is mounted on a rack 54, a pinion 55 engages with the rack 54 and is rotated by a motor 56 to shift the rack 54 in its longitudinal direction.

A cartridge P is manually supplied and inserted to the cartridge holder 34 which stops at the first stop position S1 through a supply opening 23 formed on an upper portion of the casing 21. The supply opening 23 is opened and closed with a lid which is not shown.

As shown in FIG. 2, on one side of the second stop position S2 of the cartridge holder 34 are installed a cutting device 60 and a punching device 70. The cutting device 60 is used to cut off the tapered tongue "f" of the end portion of the film strip F drawn onto the table 22 and the punching device 70 is used to punch out coupling holes 4 on the end portion of the film strip F.

Figure 5A:
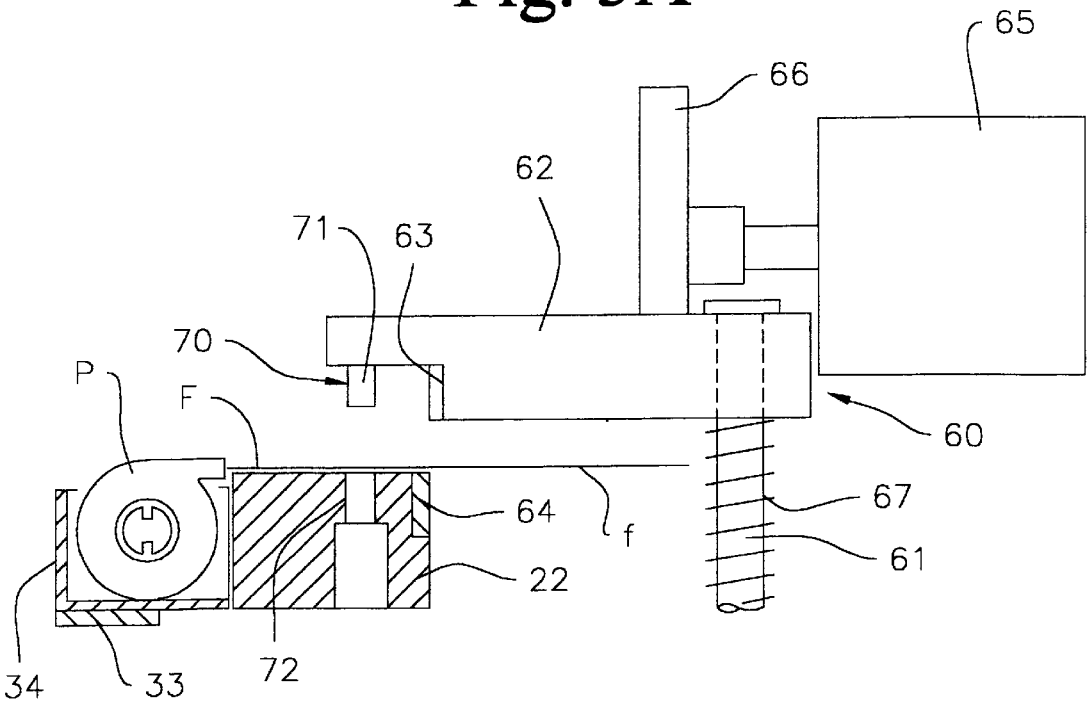
FIGS. 5A and 5B are respectively a front view of the cutting device and the punching device, and a plan view thereof.
Figure 5B:
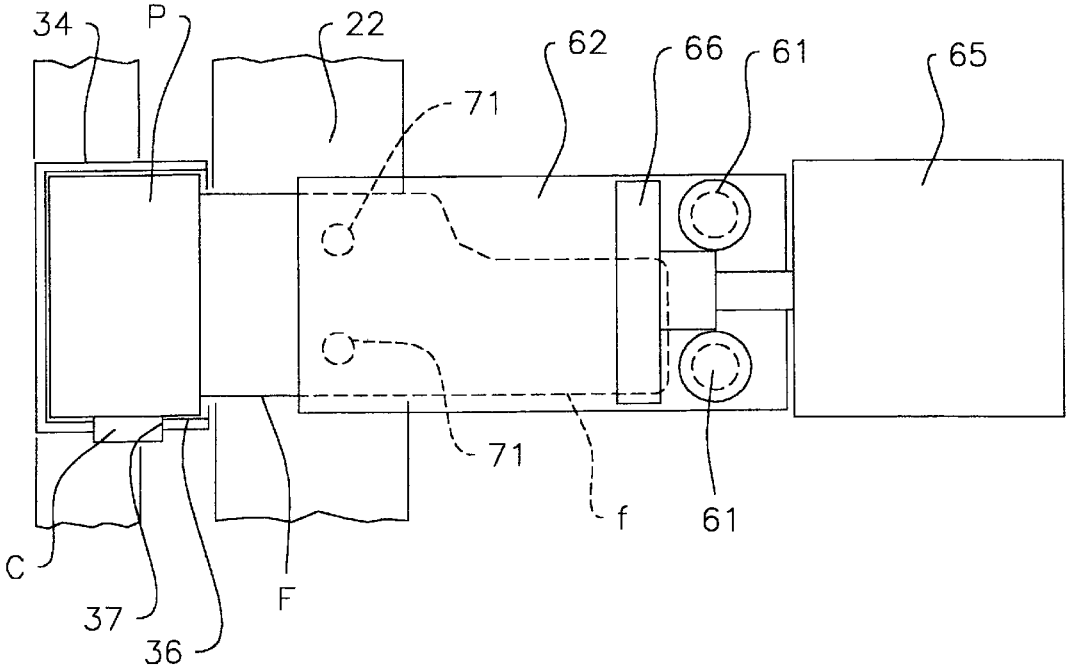

As shown in FIG. 5, in the cutting device 60 an upper blade 63 is fitted to a plate-like upper blade holder 62 which is supported so as to move up and down along two guide shafts 61. Further, a lower blade 64 facing the upper blade 63 is fixed to one side of the table 22. The upper blade holder 62 is moved up and down through rotation of a cam 66 rotated by a motor 65 associated with an elastic force from a spring 67 supported by the guide shafts 61. Therefore, the film strip F is cut by the upper blade 63 and the lower blade 64 when the upper blade holder 62 comes down.

In the punching device 70, a plurality of punching rods 71 are fitted to the lower surface of the upper blade holder 62. The counter holes 72 facing the punching rods 71 are formed in the table 22 and the punching rods 71 punch through a film strip F when the upper blade holder 62 comes down.

As shown in FIG. 2, at one side of the third stop position S3 a label attaching device 80 is installed. The label attaching device puts a reinforcing label 5 on an upper surface of the punched film strip F.

The reinforcing label 5 is used to reinforce the coupling strength with the leader sheet L. It is preferable to use the reinforcing label 5 because if the film strip F is caught while being developed, it might be torn at the coupling holes 4.

Figure 6A:
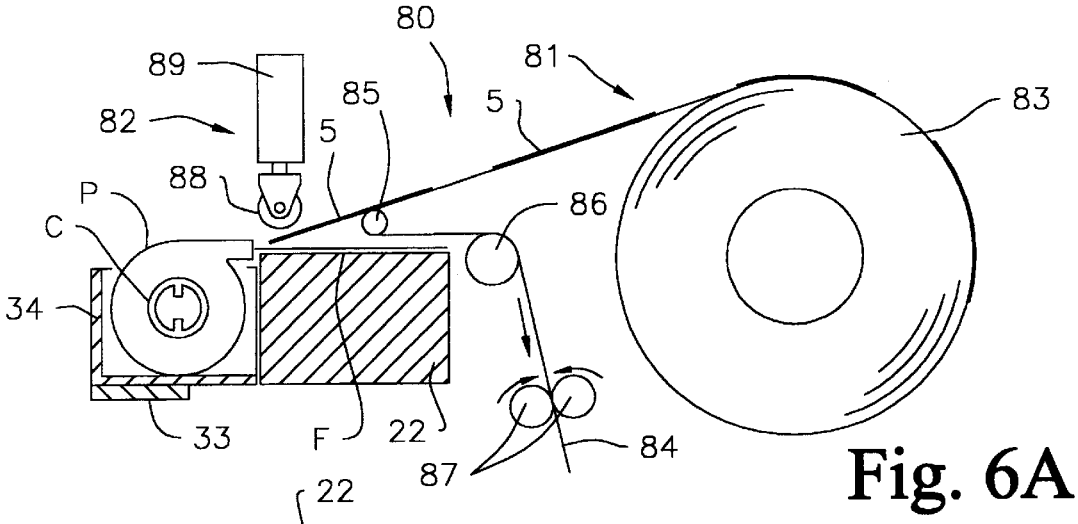
FIGS. 6A, 6B and 6C are respectively a front view of the label sticking device, a plan view thereof, and a front view showing its working condition.
Figure 6B:
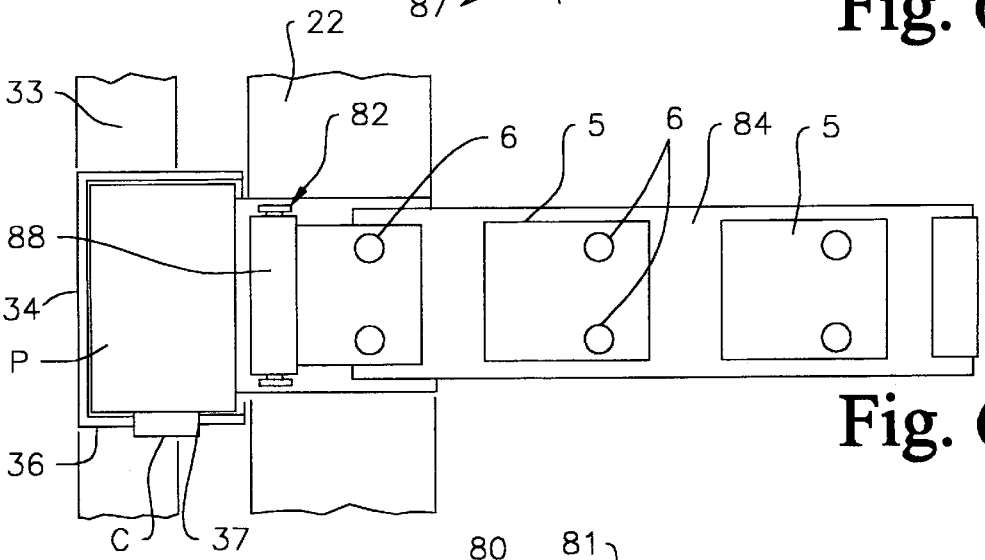

As shown in FIG. 6, the label attaching device 80 comprises a label feeding unit 81 and a pressing device 82 which attaches the reinforcing label 5 fed by the label feeding unit 81 on the upper surface of the film strip F. In the label feeding unit 81, a separator 84 is removed above the table 22 from a rotatably supported label roller 83. The separator 84 is turned back in its traveling direction guided by a first guide 85 composed of rollers, and is guided by a second guide 86 so as to be inserted between a pair of feed rollers 87. The separator 84 is moved by the rotation of the feed rollers 87 in a direction shown by an arrow so that the reinforcing label 5 stuck on the separator 84 may be peeled off the separator 84 at the first guide 85.

When a reinforcing label 5 is removed from the separator 84, the pair of feed rollers 87 shift the separator 84 until a predetermined length of the end portion of the next reinforcing label 5 is peeled off so as to keep the next reinforcing label 5 standing-by in a sticking position.

A pressing device 82 comprises a press roller 88 and a solenoid 89 to move the press roller 88 down onto the top face of the table 22.

When a cartridge holder 34 is moved to and stopped at the third stop position S3, the solenoid 89 of the pressing device 82 is actuated to lower the press roller 88. The lowering roller 88 attaches the end portion of the reinforcing label 5 onto the upper surface of the film strip F.

Figure 6C:
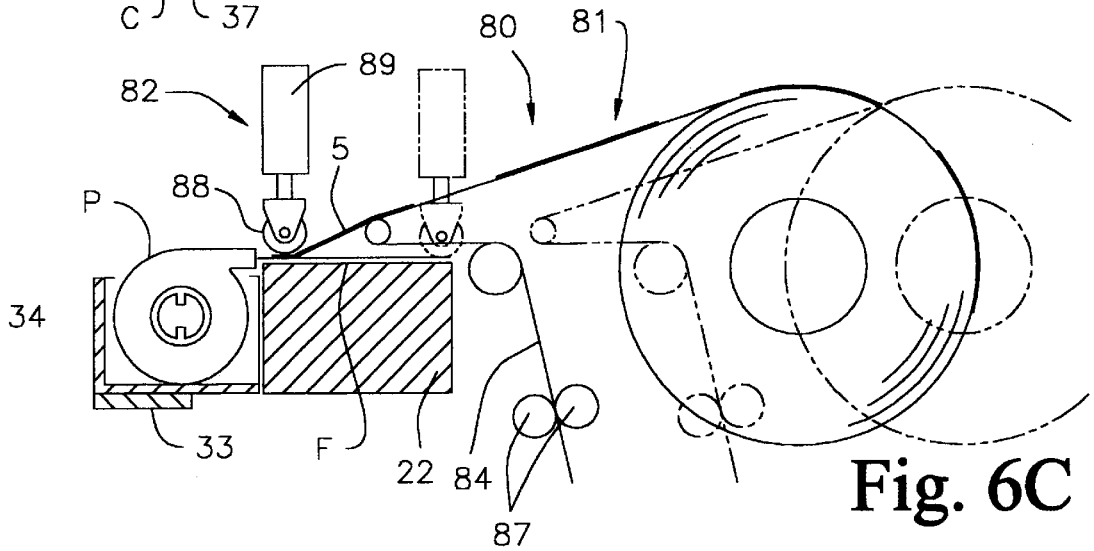

When the press roller 88 presses the reinforcing label 5, then the pressing device 82 and the label feeding unit 81 move to the respective positions shown by the dotted line in FIG. 6C. With this movement, the reinforcing label 5 is completely peeled off the separator 84 and at the same time is stuck onto the end portion of the film strip F by the press roller 88.

A pair of holes 6 are formed in the reinforcing label 5 and the holes 6 are larger than the coupling hole 4 formed on the film strip F. The reinforcing label 5 is stuck on the upper surface of the film strip F so that the holes 6 match up with the coupling holes 4.

Figure 7:
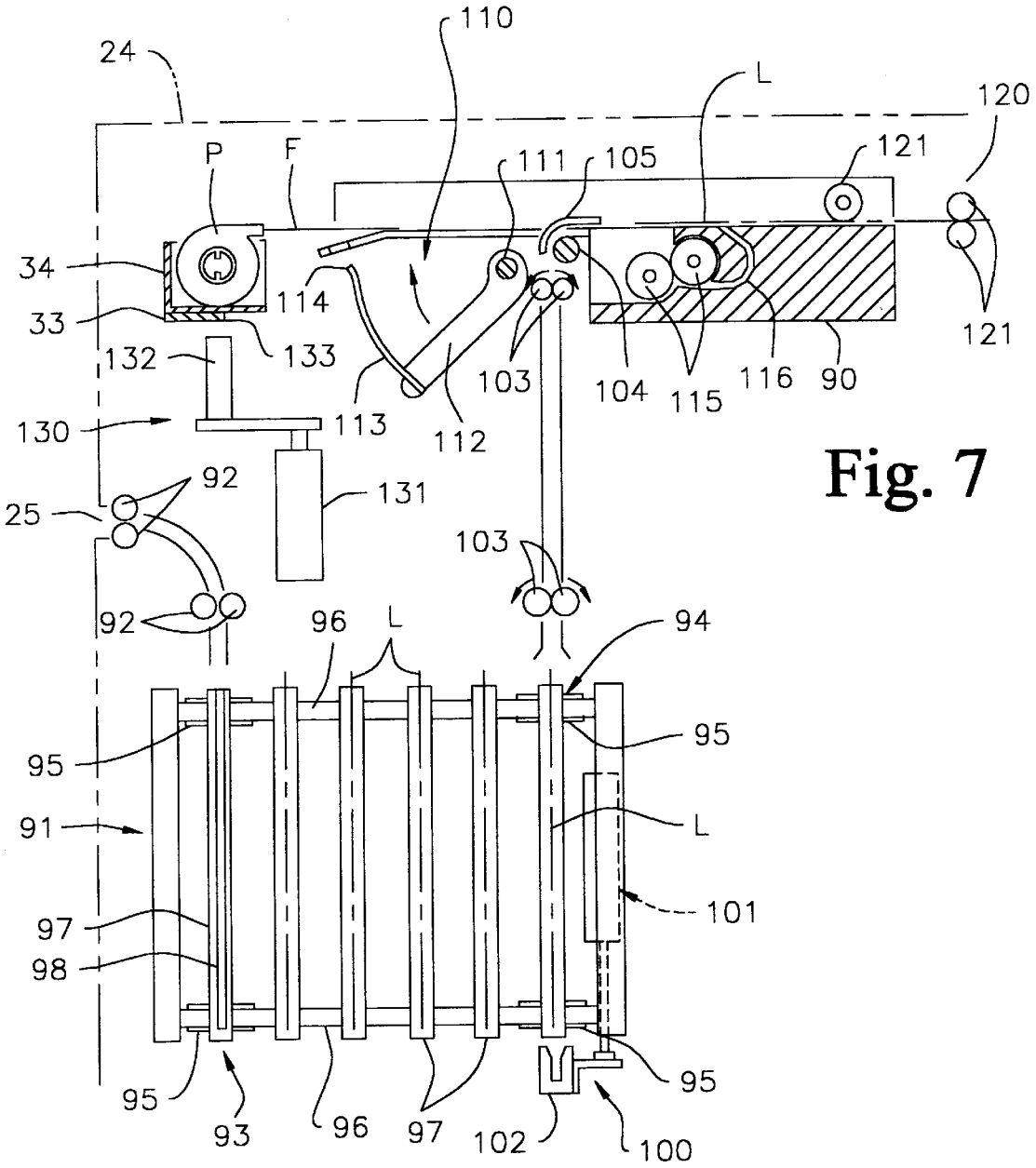
FIG. 7 is a cross sectional view taken on line VII—VII of FIG. 2.

As shown in FIG. 2, the fourth and the fifth stop positions S4, S5 of the cartridge holder 34 face the entrances of the film developing section 10. As shown in FIG. 7, between the fourth and the fifth stop positions S4, S5 and the film developing section 10, and close to each stop position of S4, S5, a leader sheet table 90 is arranged to support the leader sheet L.

Further, a leader sheet stocking section 91 is arranged below the fourth and fifth stop positions S4, S5.

On a side wall 24 of the leader sheet stocking section 91, a leader sheet throw-in opening 25 is arranged. A leader sheet L passed through the leader sheet throw-in opening 25 is conveyed by a plurality of feed rollers 92 to a leader sheet conveyer 93 installed in the leader sheet stocking section 91.

Figure 8:
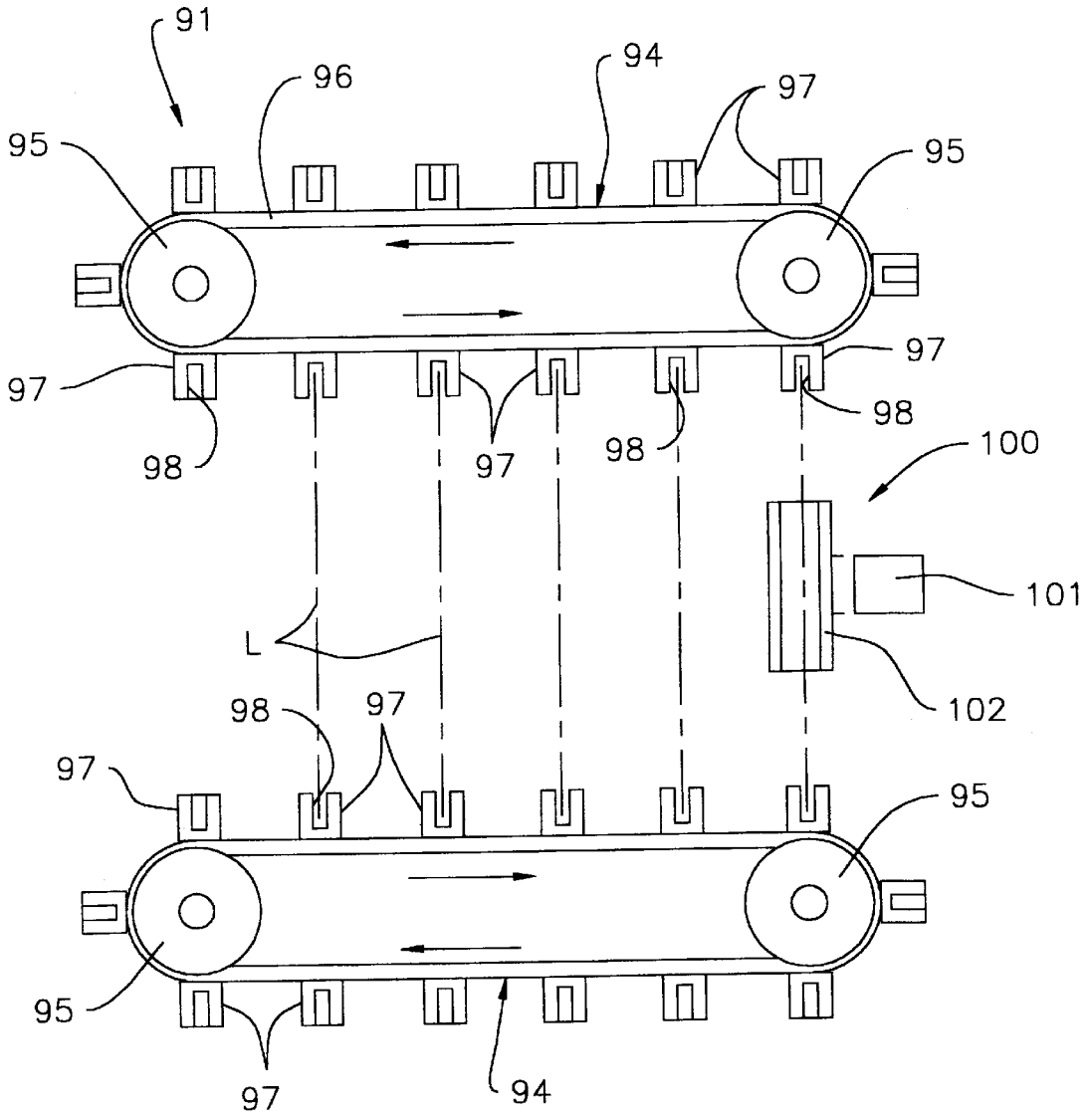
FIG. 8 is a plan view of the above leader sheet conveyer.

As shown in FIGS. 7 and 8, the leader sheet conveyer 93 comprises a pair of guide-transfer devices 94, 94 facing each other. Each guide-transfer device 94 has upper and lower endless belts 96 installed between a pair of pulleys 95 located in the front and rear and face each other. The upper and the lower belts 96 are connected to each other by a plurality of leader sheet guides 97 which are fitted thereto and are equally spaced along the belts 96. With a shift of the belts 96, the leader sheet guide 97 is intermittently moved by a stroke equal to a pitch between the leader sheet guides 97 in the direction indicated by an arrow in FIG. 8 (toward the film developing section 10).

The leader sheet guide 97 has a guide groove 98 extending upwardly and downwardly. The leader sheet L fed downwardly by the feed rollers 92 is sent between a pair of left and right leader sheet guides 97 which have been stopped at a supply end of the leader sheet conveyer 93. Then both side ends of the leader sheet L are guided by the guide groove 98 formed on the leader sheet guides 97.

The leader sheet conveyer 93 conveys the leader sheet L toward the ejection end by a stroke equal to a mounting pitch between adjacent leader sheet guides 97 every time the leader sheet L is fed between the left and the right leader sheet guides 97.

This mechanism allows a plurality of leader sheets L to be stocked in the leader sheet conveyer 93. The leader sheet conveyed to and stopped at the ejection end of the leader sheet conveyer 93 is conveyed onto a leader sheet table 90 by an operation of a leader sheet supplying device 100.

In the leader sheet supplying device 100, an elevator table is installed under the leader sheet L that is conveyed to and stopped at the ejection end of the leader sheet conveyer 93. The elevator table 102 is lifted and lowered through operation of an elevator device 101. The leader sheet L is lifted by the elevator table 102 upwardly along a pair of left and right leader sheet guides 93 and it is conveyed up by the rotation of pairs of feed rollers 103 installed in a lift path. The leader sheet L is conveyed until the leader sheet L turns its running direction by 90 degrees using a turn roller 104 and a turn guide 105 which are arranged at a side portion of the leader sheet table 90. Finally the leader sheet L is conveyed onto the leader sheet table 90.

A cylinder or a screw shaft may be used as an elevator device for the elevator table 102. The leader sheet L is conveyed upward with its first and second insert slots 1, 2 located on the lower side.

The leader sheet L that is conveyed to and stopped at the table 90 is coupled by an operation of a splicing device 110 with the film strips F in the cartridges P which have stopped at the fourth and the fifth stop positions S4, S5.

Figure 9:
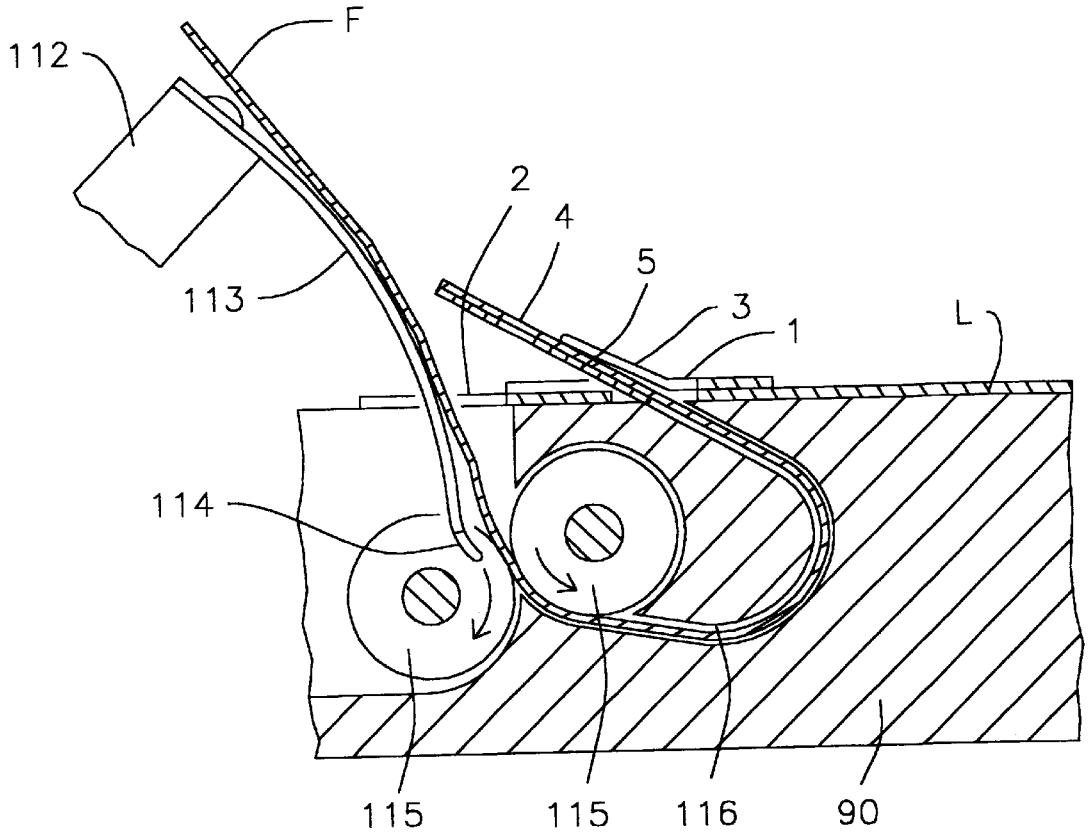
FIG. 9 is a cross sectional view indicating the splicing of a leader sheet and a film.

As shown in FIGS. 7 and 9, between the fourth and the fifth stop positions S4, S5 and the leader sheet table 90, the splicing device 110 has a rotary shaft 111 to which a pair of swing arms 112 are attached. Attached to an end portion of each swing arm 112 is an arcuate plate 113 whose end portion is formed into a pair of pawls 114 which are capable of engaging with the coupling holes 4 formed on the film strip F. Therefore, when the swing arm 112 is made to swing by rotation of the rotary shaft 111 in the direction indicated by the arrow, the pawls 114 engage with the coupling holes 4 on the film strip F and draw the film strip F out of the cartridge. The film strip F is then guided and inserted by its end portion into the second insert slot 2 formed on the leader sheet L and then it is sent between a pair of nip rolls 115 installed in the leader sheet table 90.

Further, the leader sheet table 90 has a guide path 116 to guide the end portion of the film strip F sent by the rotation of the nip rolls 115 to the first insert slot 1 formed on the leader sheet L. When the end portion of the film strip F sent along the guide path 116 is inserted into the first insert slot as shown in FIG. 9, coupler tongues 3 traversing the first insert slot 1 are elastically deformed upward, and when the tips of the coupler tongues 3 meet the coupling holes 4, the nip rolls 115 are reversed so that the film strip F is sent back by a predetermined distance. By this action the coupler tongues 3 are made to engage with the coupling holes 4.

The leader sheet L, coupled with two film strips F, is then sent to a film developing section 10 by an operation of a leader sheet conveying device 120 and simultaneously the cartridge P in the cartridge holder 34 are pushed up and taken up therefrom by a push-up device 130 installed thereunder. They are then conveyed with the leader sheet L to the film developing section 10.

In the leader sheet conveying device 120, a plurality of pairs of upper and lower feed rollers 121 are installed at predetermined intervals along a traveling path of the leader sheet L in the leader sheet traveling direction. Therefore, the leader sheet L may be sent to the film developing section 10 by the rotation of each feed roller 121.

In the push-up device 130, a rod 132, lifted and lowered by a cylinder 131, is installed under the cartridge holder 34 which stops at the fourth and fifth stop positions S4, S5. When the rod is lifted, the top of the rod is inserted into holes 133 formed through the belt 33 and the bottom plate of the cartridge holder 34 so that the cartridge is pushed up.

A film supplying apparatus of the embodiment is constructed as described above. When the film is to be developed, the cartridge with an undeveloped film strip F wound inside is manually supplied through a supply opening 23 into the cartridge holder 34 which stops at the first stop position S1 of the cartridge conveying device 30.

When a cartridge P is supplied into a cartridge holder 34, the whole rotating device 50 moves toward the cartridge holder 34 so that the engaging shaft 52 is inserted into the coupling hole "e" of the spool "c". The tapered tongue of the film strip F of the cartridge P is then drawn out by the operation of the rotating device 50 and the tapered tongue drawing device 40.

The cartridge P with its tapered tongue drawn out is conveyed by a predetermined stroke by operation of the cartridge conveying device 30. By this intermittent stroke, an empty cartridge holder 34 is sent into the first stop position S1. Every time when the empty cartridge holder 34 stops at the first stop position S1, a cartridge P is supplied into the empty cartridge holder 34.

When the cartridge P with its tapered tongue drawn out is sent to and stopped at the second stop position S2, the cutting device 60 is actuated to cut off the tapered tongue "f" of the end portion of the film strip F. At the same time, the punching device 70 is actuated to punch out the coupling holes 4 on the end portion of the film strip F.

After having been formed with the coupling holes 4, the film strip F is sent to the third stop position S3. When the cartridge P is sent to and stopped at the third stop position S3, the label attaching device 80 is actuated to attach the reinforcing label 5 on the upper surface of the end portion of the film strip F.

After the label is attached thereon, the film strip F is sent to the fourth stop position S4 and then to the fifth stop position S5. When respective cartridges P are sent to and stopped at the fourth and fifth stop positions S4, S5 respectively, the splicing device 110 starts working.

At that time, the leader sheet L is supplied and stands by on a leader sheet table 90. The film strips F in the cartridges P which have stopped at the fourth and the fifth stop positions S4, S5 are drawn out of the cartridges P by the operation of the splicing device 110 and then are inserted through the second insert slots 2 into the first insert slots 1. The coupler tongues 3 then engage with the coupling holes 4 to splice the film strips F with the leader sheet L.

After the film strips F have been spliced, the push-up device 130 is actuated to push up the cartridges P out of the cartridge holders 34. When the cartridges P are taken up out of the cartridge holders 34, the leader sheet conveying device 120 is actuated to send the leader sheet L to the film developing section 10 and the cartridges P also are conveyed to the film developing section with the leader sheet L.

The cartridge P is stopped and held at a position before entering the film developing section 10. The film strip F is drawn out of the cartridge P by the movement of the leader sheet L to be conveyed to the film developing section 10. When the end portion of the film strip F is drawn out of the cartridges P, the film strip F is cut at its end portion and the film strip F is conveyed to the film developing section 10 to be developed.

As described above, once the cartridge is placed in the cartridge holder 34, the preparative works such as drawing out of the tapered tongue of the film strip F, cutting off the tapered tongue, attaching the label and coupling with the leader sheet L, are all automatically carried out. Since the film strip F, with these preparative works having been finished, is sent to the film developing section 10 together with the leader sheet, the film strip F is allowed to be developed efficiently.

Further, since the film strip F is coupled with the leader sheet L in a casing 21, the film strip F is prevented from being exposed.

Figure 10:
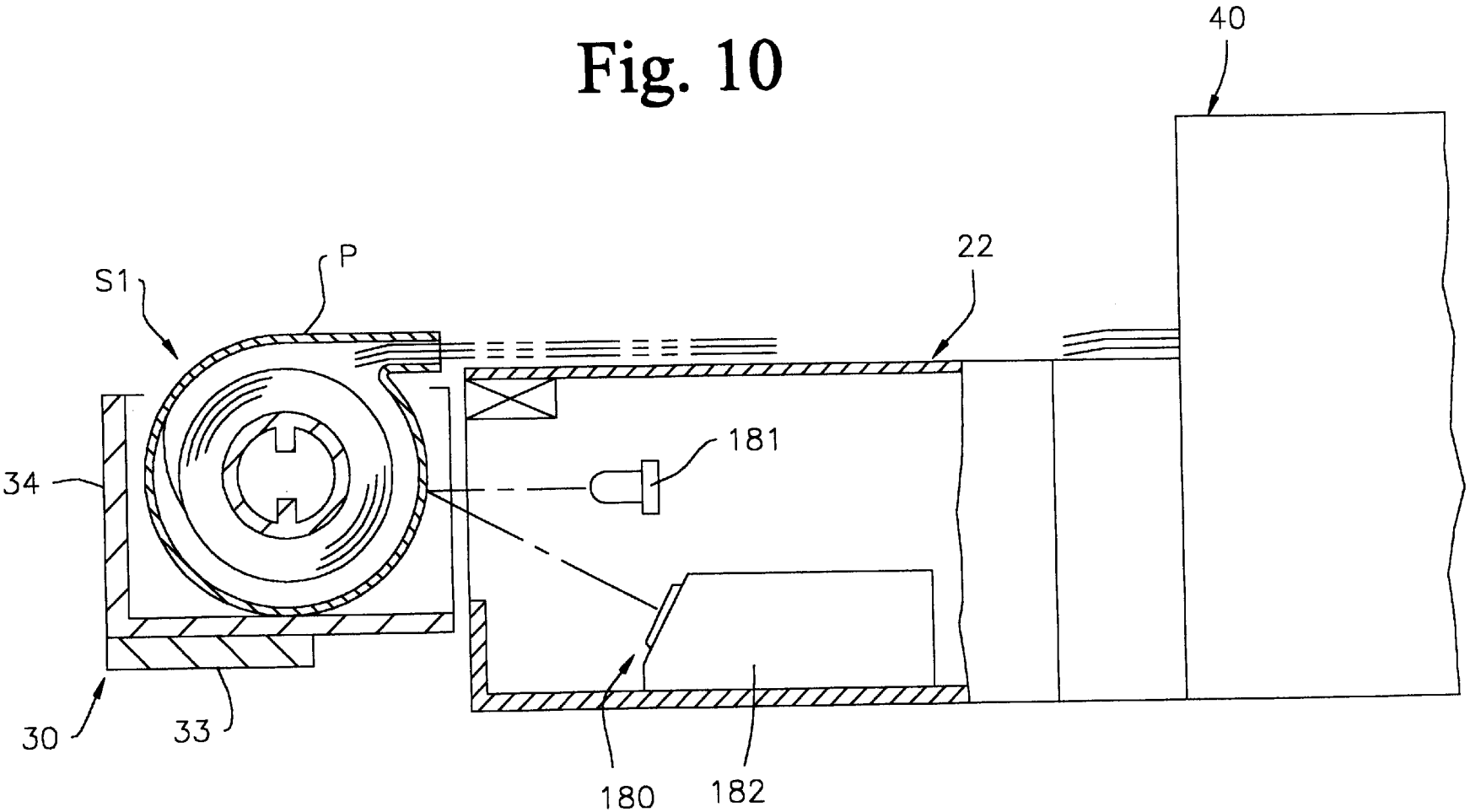
FIG. 10 is a cross sectional view illustrating another embodiment of a cartridge conveying section.

FIG. 10 shows another embodiment of a cartridge conveying section. This cartridge conveying section is equipped with a bar code reading device 180 which is placed so as to face the first stop position S1 of the cartridge P conveyed by the cartridge conveying device 30 in order to read a bar code attached to an outer surface of the cartridge P.

The bar code reading device 180 comprises a light emitter 181 and a light sensor 182 for receiving the light reflected by the cartridge so as to read the bar code. The light emitter 181 and the cartridge P supported by the cartridge holder 34 are controlled to be moved with each other. The light sensor 132 reads the bar code and judges whether the film strip F wound in the cartridge P can be processed or not.

In case that the film strip F wound in the cartridge P is not to be processed, an operator is audibly informed of this and then the operator takes the cartridge out of the cartridge conveying device 30 or the cartridge is discharged from the discharge end of the cartridge conveying device 30 without being submitted for processes such as the tapered tongue draw-out.

As described above, since the bar code reading device 130 for reading the bar code is installed at the first stop position S1 of the cartridge P so as to judge whether the film strip F in the cartridge P can be processed or not and to take the cartridge P out of the cartridge conveying device 30 in case of the film strip F is not to be processed, the film strip F which is not to be processed is prevented from being sent into the film developing section 10.

Figure 11:
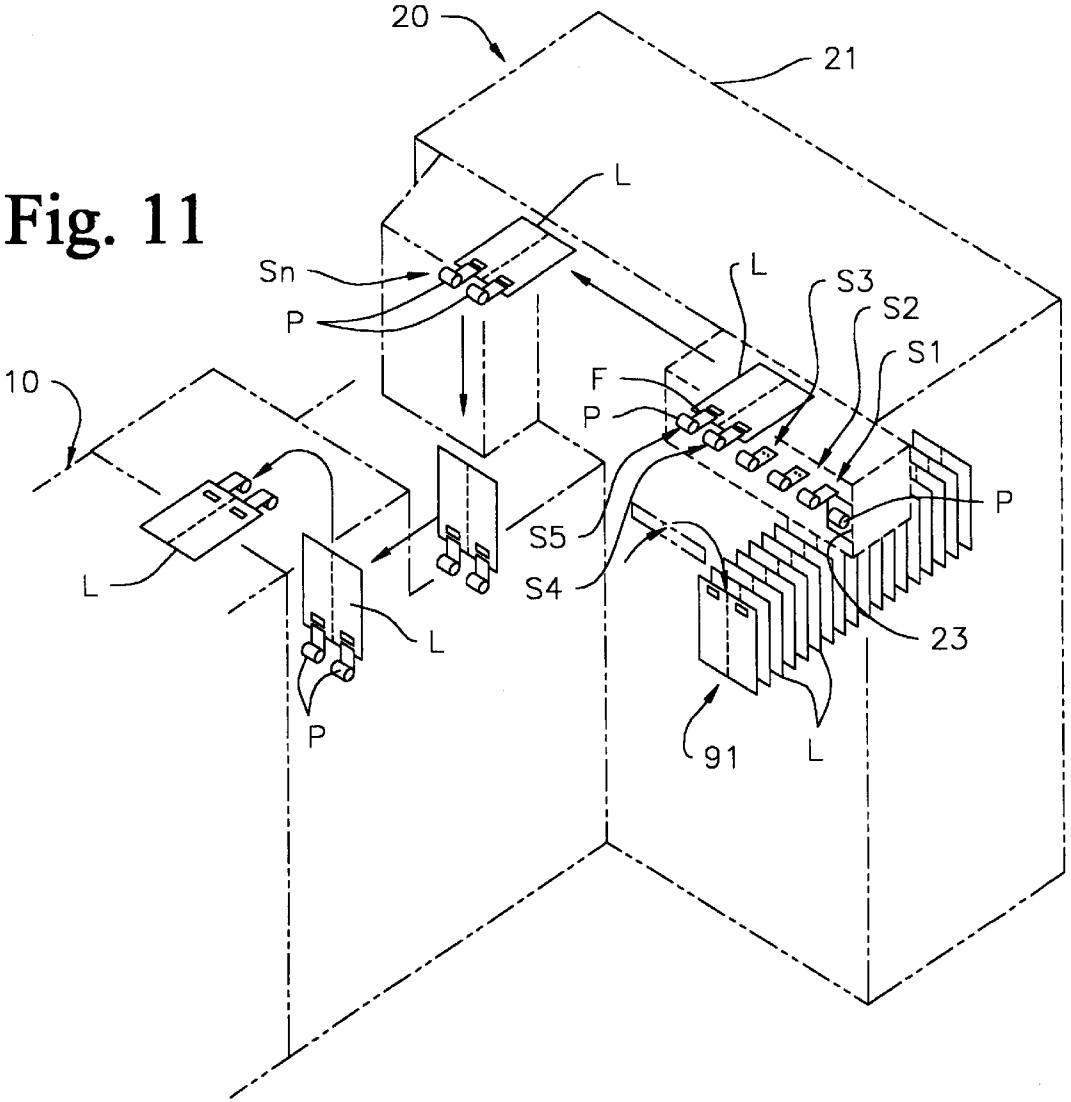
FIG. 11 is a schematic view of another embodiment of the present invention showing transportation of the leader sheet and cartridge toward the developing section.

FIG. 11 shows another aspect of a film supplying apparatus of the present invention. In this aspect, the flows of a cartridge P and a leader sheet L are schematically described. At a film supplying section 20 connected to the entrance side of a film developing section 10, a cartridge P is placed inside thereof through a supply opening 23 in the casing 21 and is intermittently moved in the direction indicated by an arrow by a device equivalent to the cartridge conveying device 30 shown in FIG. 3. At the first stop position S1, a tapered tongue of a film strip F is drawn out. At the second stop position S2, the tapered tongue cutting and the punching steps are carried out. At the third stop position S3, a reinforcing label 5 is attached.

Further, at the fourth and the fifth stop positions S4, S5, the film strips F are spliced with a leader sheet L which has been sent from a leader sheet stocking section 91 to the other side of the stop positions S4 and S5 and has been stopped. The spliced leader sheet L is then sent to the nth stop position Sn.

When the leader sheet L is conveyed to and stopped at the nth stop position Sn, the leader sheet L with the cartridges P in the front is moved downwardly while turning the direction of the leader sheet L by 90 degrees and making it vertical. After having been conveyed horizontally while keeping the attitude thereof vertical, the leader sheet L is conveyed upwardly and is turned by 90 degrees to be sent into the film developing section 10.

In addition, the leader sheet conveyer 93 shown in FIGS. 7 and 8 may be used as a conveying device for horizontally conveying the leader sheet L held in a vertical orientation.

Figure 12:
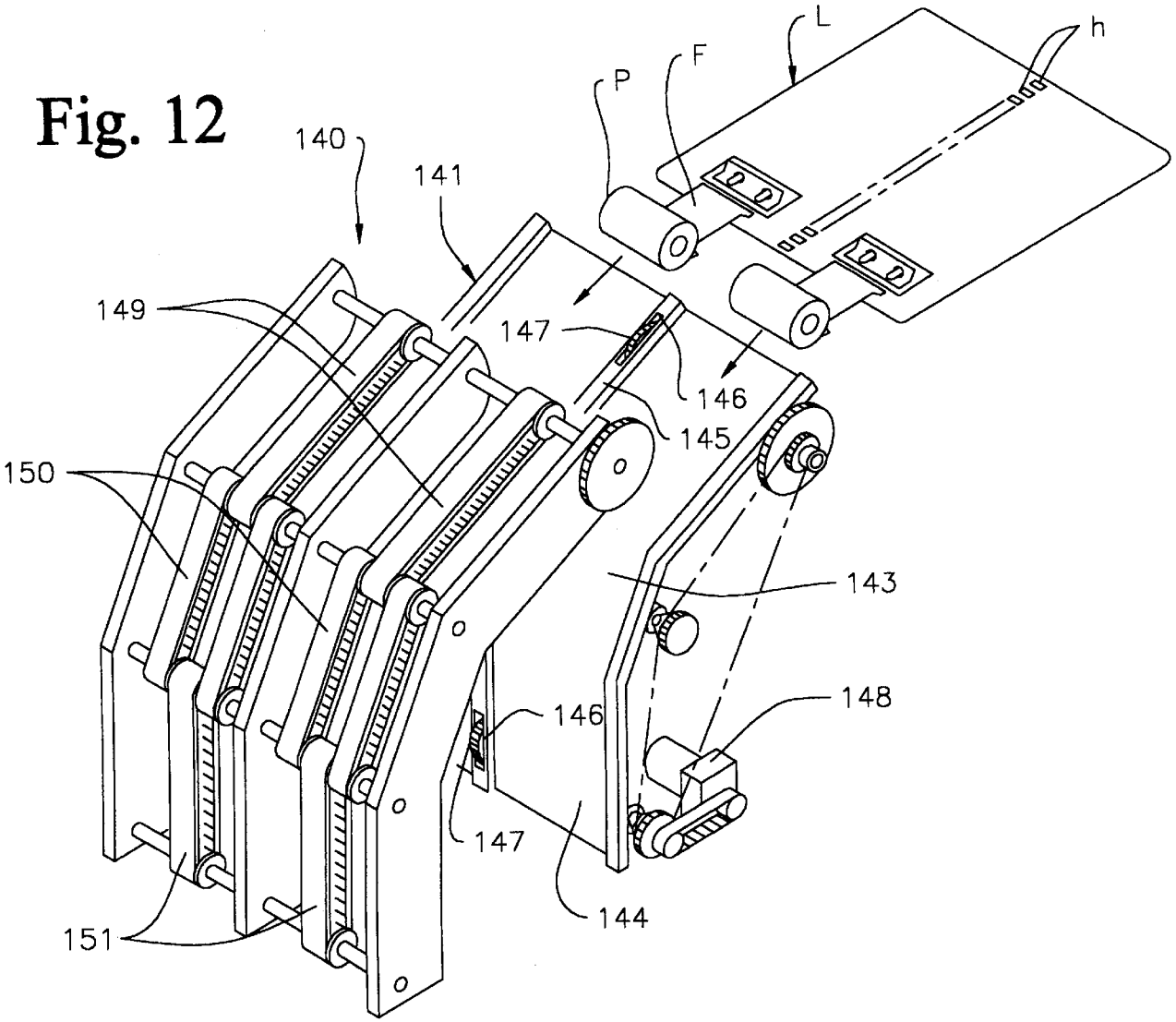
FIG. 12 is an exploded perspective view of the leader sheet transporting device.
Figure 13:
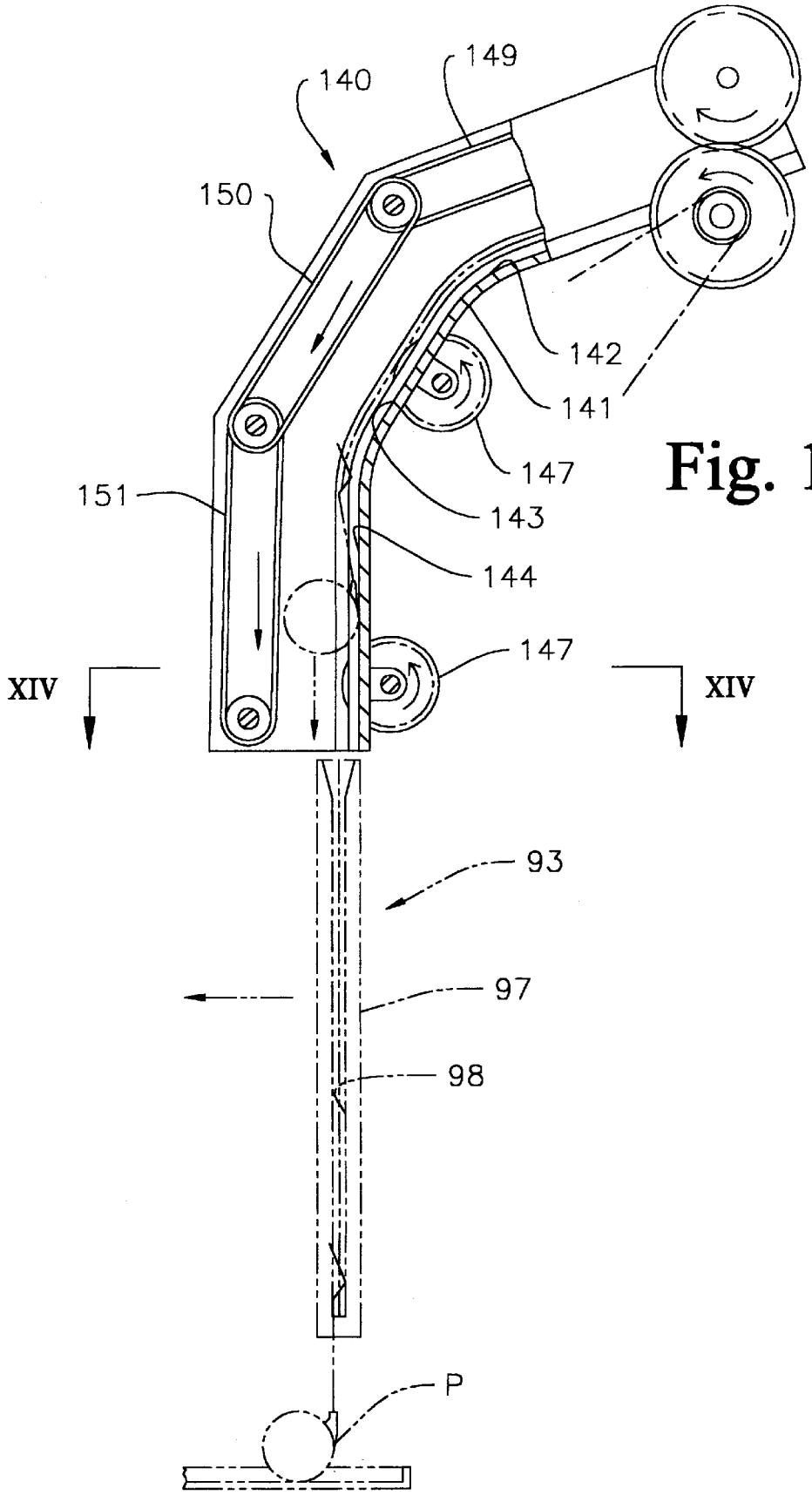
FIG. 13 is an elevational view of the leader sheet transporting device partially shown in section.
Figure 14:
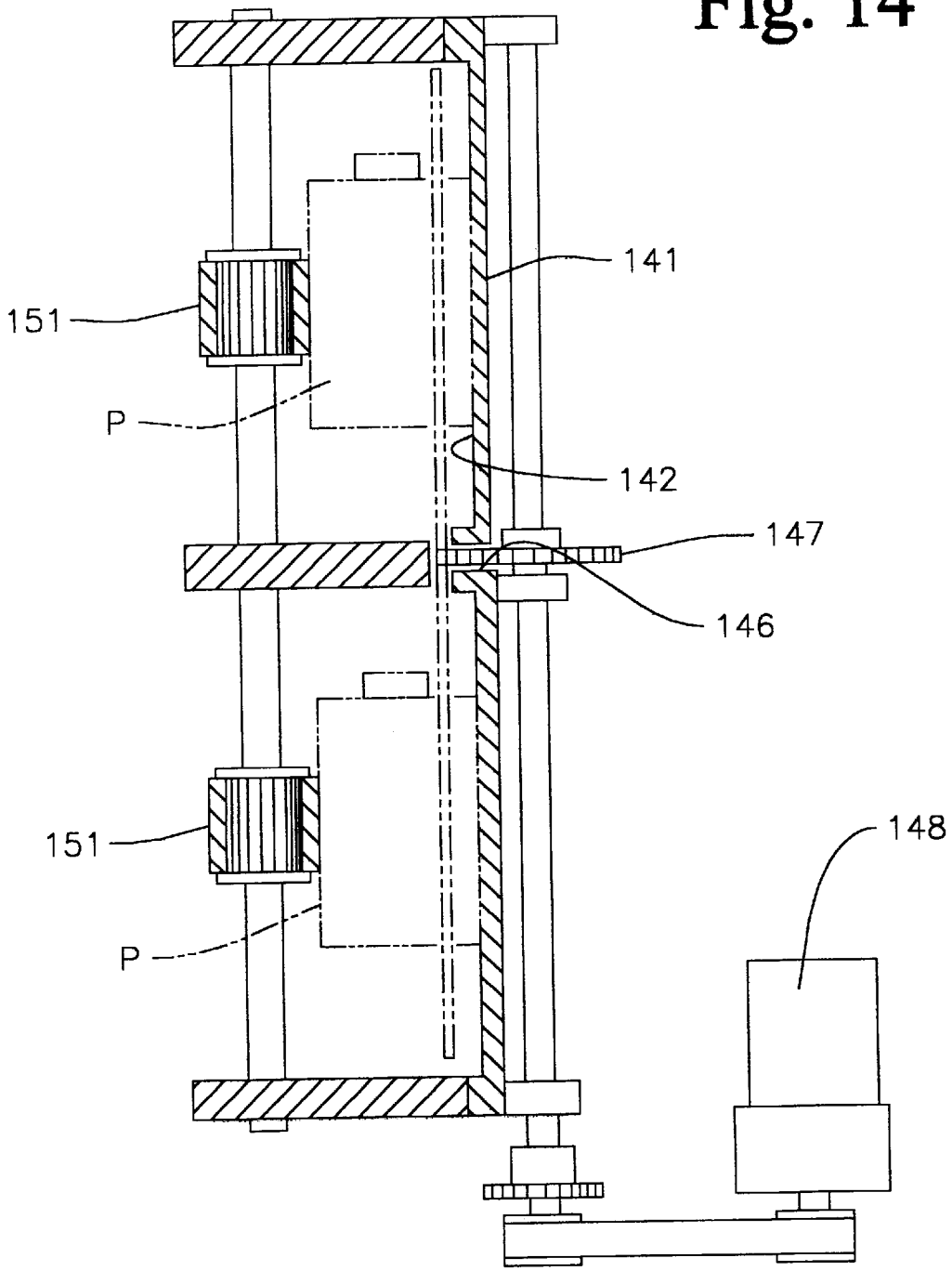
FIG. 14 is a cross sectional view taken on line XIV—XIV of FIG. 13.

Further, a leader sheet transporting device 140 shown in FIGS. 12 to 14 may be used as a device for conveying the leader sheet L with film cartridges P in front thereof downwardly while turning the direction of the leader sheet L by 90 degrees or for changing the attitude of the leader sheet L by 90 degrees while conveying them upwardly.

The leader sheet transporting device 140 has a guide member 141 which is wider than the leader sheet L and is composed of a first inclined plane 142, a second inclined plane 143 and a vertical plane 144 formed continuously in this order. At the center of each plane is formed a guide bank 145 for guiding a movement of the leader sheet L. On the guide bank 145 is disposed a plurality of slots 146 with an interval shorter than the length of the leader sheet L, and in each slot 146 is installed a sprocket 147 engageable with the row of perforations "h" on the leader sheet L for feeding the leader sheet L. Each sprocket 147 is driven by a motor 148 in one direction to transport the leader sheet L along the guide bank 145 and to feed it into the guide groove 98 in the leader sheet guide 97 of the leader sheet conveyer 93.

Holding belts 149 are disposed so as to face to each plane of the first inclined plane 142 extending on both sides of the guide bank 145. Holding belts 150 are disposed so as to face to each plane of the second inclined plane 143 and holding belts 151 are disposed so as to face to each plane of the vertical plane 144. Each of the holding belts 149, 150 and 151 is driven by the motor 148 in the direction shown by an arrow in FIG. 13. The holding belts are driven at a speed equal to that of the movement of the leader sheet L. Therefore the cartridge P may be moved at the same speed as that of the leader sheet L by holding it between each of the holding belts 149, 150 and 151 and the first inclined plane 142, the second inclined plane 143 and the vertical plane 144, respectively.

Since the cartridge P is moved at the same speed with that of the leader sheet L by holding it between each of the holding belts 149, 150 and 151 and the first inclined plane 142, the second inclined plane 143 and the vertical plane 144 respectively, the cartridge P is prevented from falling down by its own weight during transportation and the film strip F is prevented from being drawn out.

In addition, by moving the leader sheet L and the cartridge P from the vertical plane 144 to the first inclined plane 142, the leader sheet may be transported upwardly and the direction of the leader sheet L may be changed by 90 degrees.

As described above, since the film strips F are coupled with the leader sheet L at the other side of the traveling path of the cartridge P which is intermittently conveyed in one direction (i.e., at the position opposite to the film developing section 10), and the leader sheet L and the cartridges P change their positions in relationship to each other in the traveling path for conveying the spliced leader sheet L to the film developing section 10, it is possible to use a conventional film developing apparatus without a major reform by manufacturing only a new film supplying section 20. The new film supplying section 20 can then be connected to a conventional film developing system which makes the entire device extremely economical.

As described above, in the present invention since just a simple operation of placing a cartridge in a film supplying section allows the film strip in the cartridge to be coupled with a leader sheet and to be conveyed to a film developing section, efficient film development by a film developing apparatus of leader sheet conveying type can be carried out.

Further, since the film strip can automatically be coupled with the leader sheet and devices such as a tapered tongue drawing device, a film cutting device, a punching device, a splicing device, etc., are not required to be operated by people, resulting in effects such as enhancing cost performance and reducing labor cost.

Figure 16:
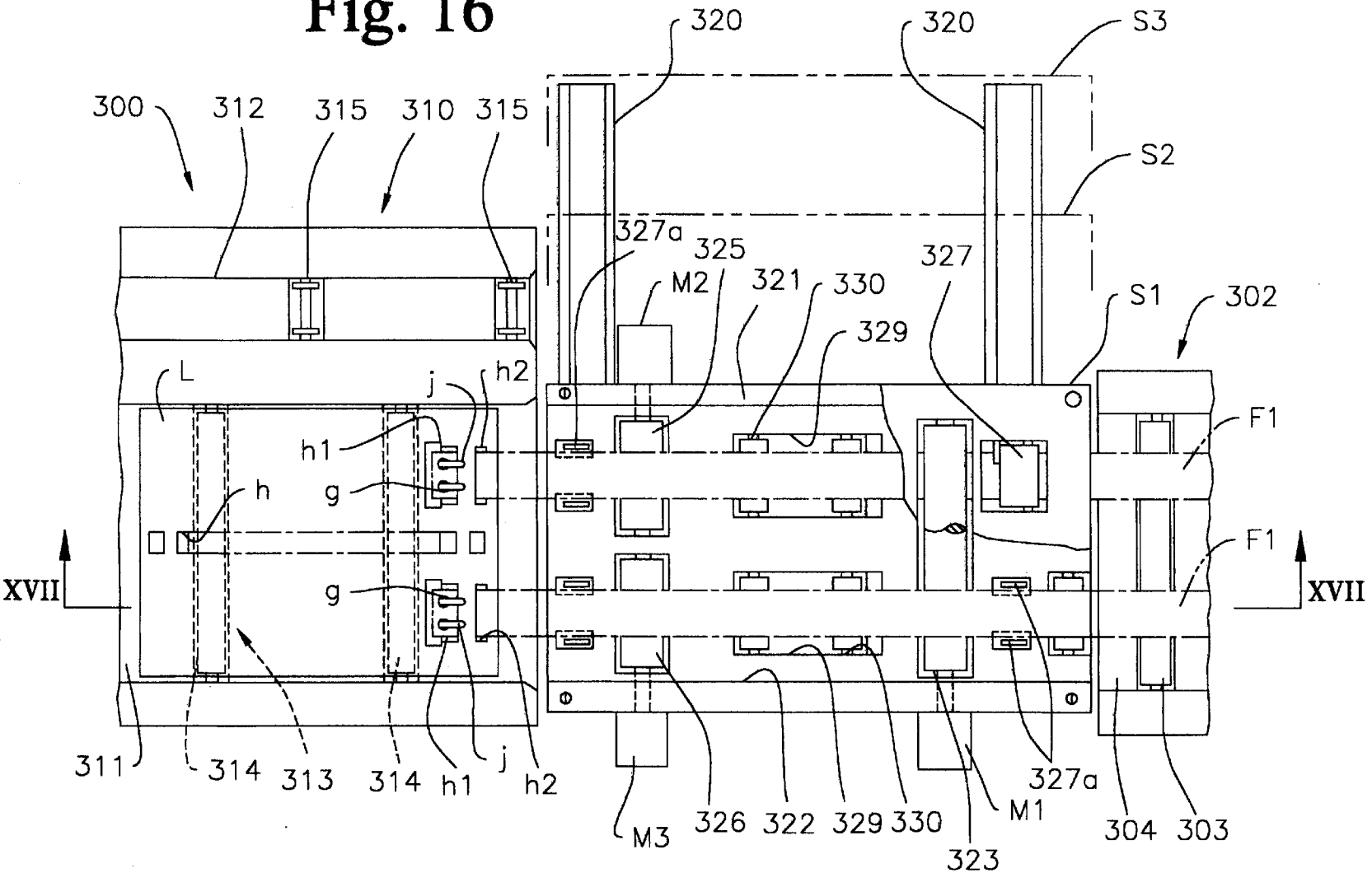
FIG. 16 is a plan view of another embodiment of the film processing apparatus including a partially sectional view.
Figure 17:
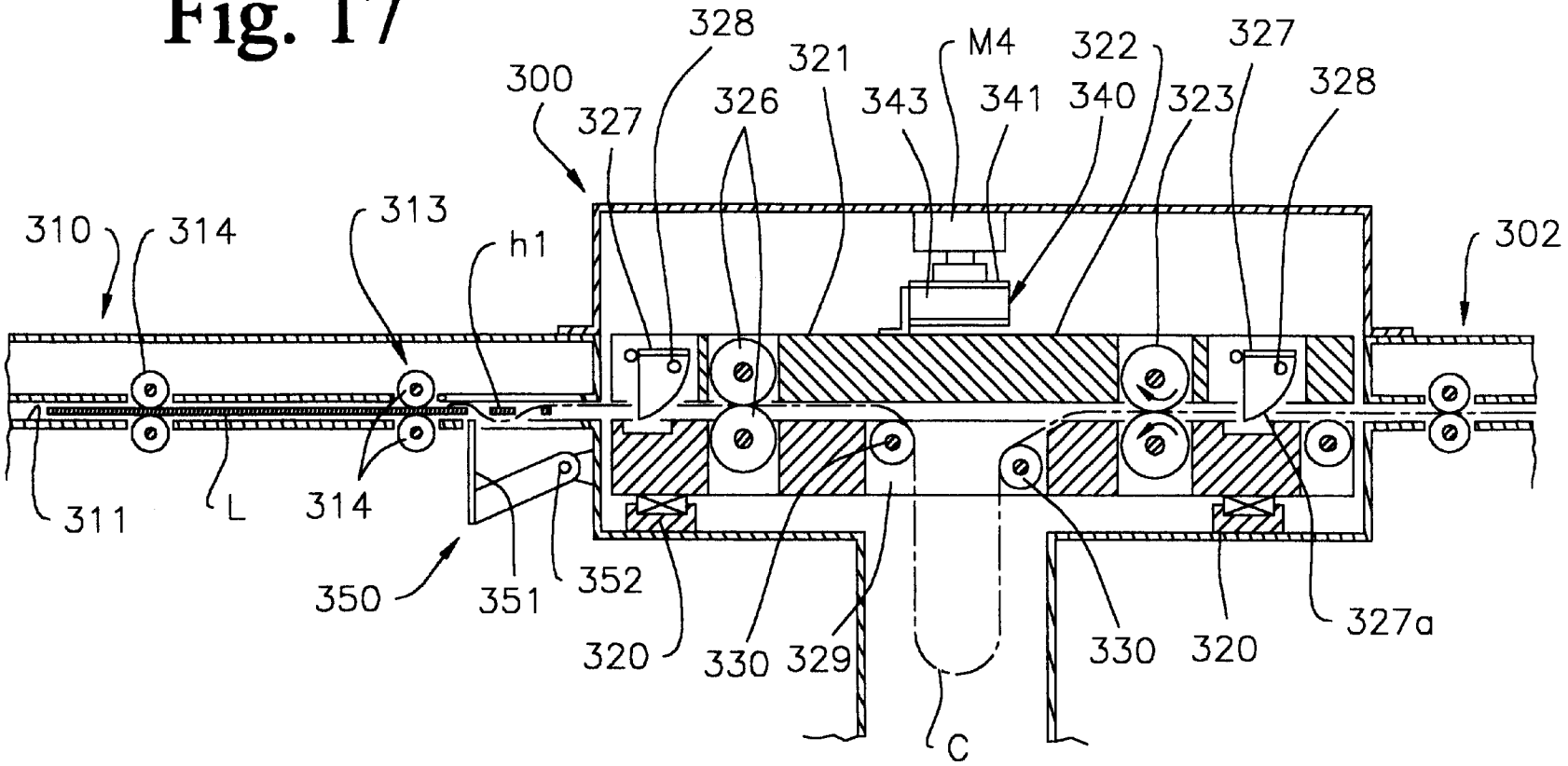
FIG. 17 is a cross sectional view taken on line XVII—XVII of FIG. 16.
Figure 18:
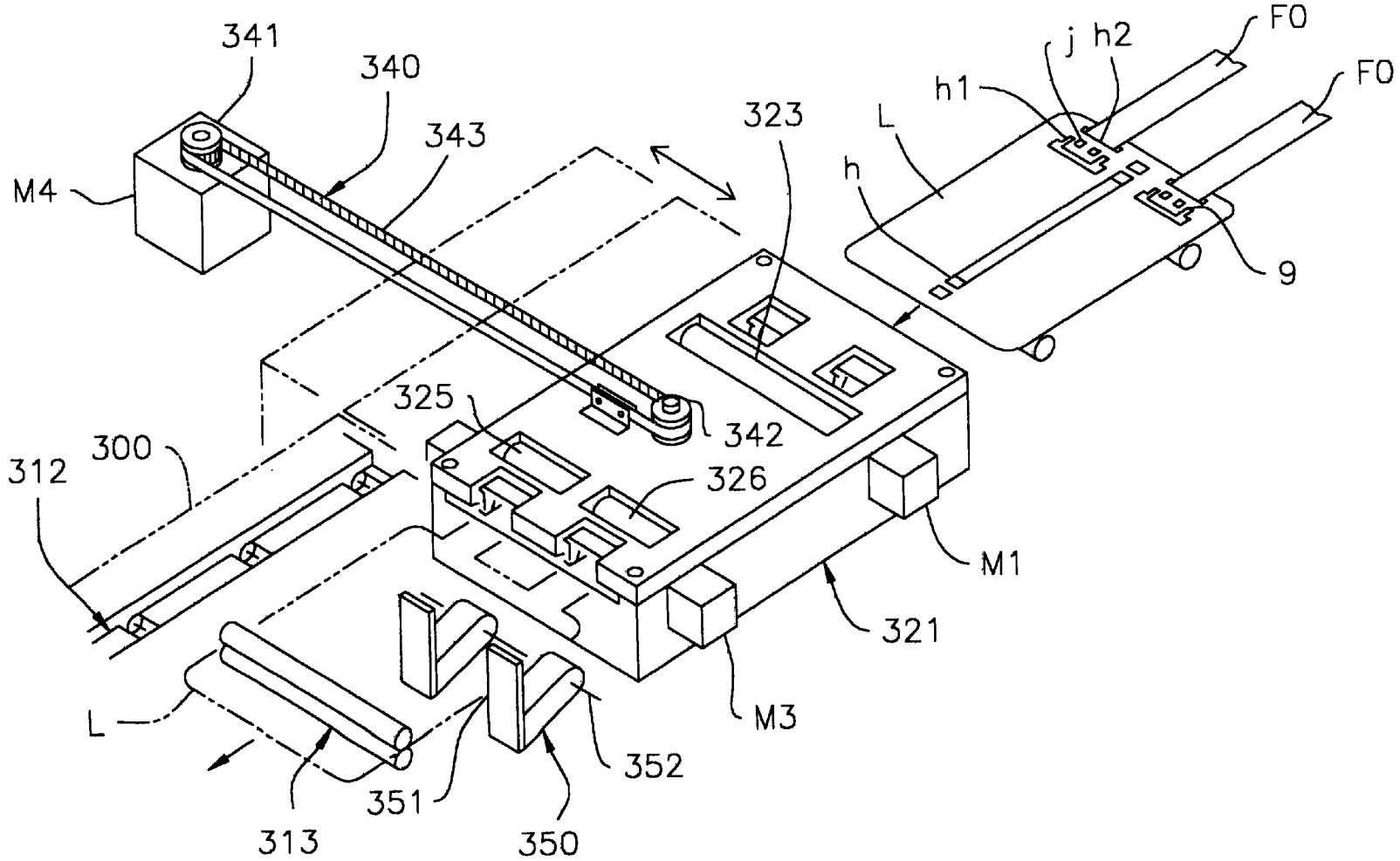
FIG. 18 is a perspective view of the photographic film processing apparatus according to the present invention including the leader sheet guide.

As shown in FIGS. 16 to 18, a photographic film processing apparatus 300 comprises a film developing section 302 for developing an undeveloped photographic film strip F0 (FIG. 18) and a printing section 310 (FIG. 16) for printing an image in the developed film strip F1 (negative film strip) onto a photographic printing paper and for developing the print processed photographic printing paper.

When being developed, the photographic film strip F0 is coupled with a leader sheet L and is sent into the film developing section 302 led by the leader sheet L.

The leader sheet L is made of flexible plastic sheet as shown in FIG. 18, and along the center line thereof, with respect to the width direction, is formed a row of perforations h spaced at constant intervals for feeding the leader sheet L. In a trailing end portion of the leader sheet L with respect to the conveying direction thereof, a first insert slot h1 and a second insert slot h2 are formed. First and second insert slots h1, h2 face one ahead of the other on both sides of the row of perforations h. From a front periphery of each first insert slot h1 with respect to the conveying direction of the leader sheet L, a pair of coupler tongues b extends toward the trailing end direction of the leader sheet L.

The front end portion of the photographic film strip F0 is inserted through the second insert slot h2 into the first insert slot h1. A pair of coupling holes g formed thereon are coupled with a pair of coupler tongues j to connect the photographic film strip F0 to the trailing end of the leader sheet L.

At the exit port of the film developing section 302, a pair of feed rollers 303 are disposed one below the other. By the rotation of the feed rollers 303, a developed film F1 is sent out of the exit port 304.

In the printing section 310 in which the film strip F1 is printed and the photographic printing paper is developed, a leader sheet supporter 311, for supporting the leader sheet L, and a film path 312, for guiding a movement of the film strip F1, are arranged in parallel.

The leader sheet supporter 311 is located in a position opposite the exit port 304 of the film developing section 302. A leader sheet conveying device 313 is also installed in the leader sheet supporter 311.

The leader sheet conveying device 313 comprises a plurality of pairs of feed rollers 314 each comprising two rollers placed one below the other. The pairs of feed rollers 314 are disposed along the leader sheet conveying direction and spaced a certain distance apart.

The film path 312 is formed to have a width capable of conveying only a single film strip F1 in the longitudinal direction. A pair of feed rollers 315 placed one below the other are installed in the film path 312.

Between the film developing section 302 and the printing section 310, a plurality of guide rails 320 are installed which extend in a direction normal to an alignment direction of the film developing section 302 and the printing section 310. A leader sheet guide 321 is also supported thereon and is movable along the guide rails 320.

The leader sheet guide 321 has a leader sheet guide path 322 extending in the alignment direction of the film developing section 302 and the printing section 310.

On the leader sheet guide path 322 are installed leader sheet feed rollers 323 composed of a pair of rollers placed one below the other for conveying the leader sheet L and the film strip F1. The leader sheet feed rollers 323 are driven by a first motor M1.

Further, on the leader sheet guide path 322 are installed a first film feed roller 325 and a second film feed roller 326 each of which is composed of a pair of rollers placed one below the other. The feed rollers 325, 326 are located on a conveying path of one of the two film strips F1 conveyed with the leader sheet L respectively. The feed rollers 325 and 326 are driven by motors M2 and M3, respectively in forward and reverse directions.

Along the film strip conveying path of the leader sheet guide path 322 is installed a plurality of film strip guides 327. The film strip guides 327 have a pair of guide plates 327*a* disposed on each side respectively for controlling movement of each side of the film strip F1. The film strip guides 327 are supported on a shaft 328 and are swingable therearound so that when the leader sheet L is conveyed along the leader sheet guide path 322, the film strip guides 327 are pushed up by the leader sheet L and swing upwardly. Then when the leader sheet L has passed, the film guides 327 swing down to control the movement of the film strip F1 which follows the leader sheet L.

Between the leader sheet feed roller 323 and the first and the second film feed rollers 325 and 326 are provided openings 329 so as to allow a loop C to hang down. The loop C may be formed when the first and the second film feed rollers 325 and 326 are stopped while the leader sheet feed roller 323 keeps rotating. Guide rollers 330 are rotatably installed in the front and the rear sides of the opening 329, respectively.

The leader sheet guide 321 is moved by a leader sheet guide shifter 340 along the guide rail 320.

The leader sheet guide shifter 340 is made up of a pair of toothed pulleys 341 and 342 disposed facing each other along the shifting direction of the leader sheet guide 321 and a timing belt 343 for joining both pulleys. Some portion of the timing belt 343 is connected to the leader sheet guide 321 and the toothed pulley 341 is driven by a motor M4.

The leader sheet guide shifter 340 mentioned above moves the leader sheet guide 321 and stops it at several positions. A first stop position S1 is located where the leader sheet guide path 322 formed on the leader sheet guide 321 faces the exit port 304 of the film developing section 302. A second stop position S2 is located where one of two film strips F1 left on the leader sheet guide path 322 face the film path 312 of the printing section 310. A third stop position S3 is located where another film strip F1 faces to the film path 312.

As shown in FIG. 17, a uncoupling mechanism 350, for releasing the coupling between leader sheet L and the film strip F1, is installed under the leader sheet supporter 311 formed in the printing section 310.

In the uncoupling mechanism 350, a uncoupling arm 351, which is made of a plate member and disposed under the leader sheet supporter 311, is supported on a shaft 352 swingable therearound upwardly and downwardly. When moved upwardly, the uncoupling arm 351 is inserted into the first insert slot h1 of the leader sheet L, which has been stopped on the leader sheet supporter 311, so as to push up the front end portion of the film strip F1.

The photographic film processing apparatus is structured so that when the leader sheet L and the film strips F1 are sent out from the exit port 304 of the developing section 302, the leader sheet guide 321 is held at the first stop position S1 where an inlet port of the leader sheet supporter 311 faces the exit port 304.

When the leader sheet L comes out from the film developing section 302 after the leader sheet guide 321 has stopped at the first stop position S1, the leader sheet L is introduced into the leader sheet guide path 322 of the leader sheet guide 321.

At that time, since the leader sheet feed roller 323 and the film feed rollers 325, 326 are rotated, the leader sheet L introduced into the leader sheet guide path 322 is sent to the leader sheet supporter 311 of the printing section 310 by rotation of the rollers 323, 325 and 326. Further the leader sheet L is sent in the same direction by the rotation of the feed roller 314 installed in the leader sheet supporter 311.

When the leader sheet L is located in a position where the first insert slot h1 of the leader sheet L faces the uncoupling arm 351, the first feed roller 325, the second feed roller 326 and the feed roller 314, installed in the leader sheet supporter 311, all stop. Only the leader sheet feed roller 323 keeps rotating to send each of the two film strips F1 in the same direction.

Consequently, each of the film strips F1 forms a loop "C", as shown by a chain line in FIG. 17, between the first and the second film feed rollers 325, 326 and the leader sheet feed roller 323. The loop C hangs down in the opening 329.

When the trailing end of each film F1 is completely out of the film developing section 302 and is in the leader sheet guide path 322 of the leader sheet guide 321, the leader sheet feed roller 323 stops rotating.

When the leader sheet L moves to the predetermined position of the leader sheet supporter 311 of the printing section 310 as shown in FIG. 16, it is stopped. The uncoupling arm 351 shown in FIG. 17 is moved upwardly so the tip of the uncoupling arm 351 is inserted into the first insert slot h1.

Figure 19A:
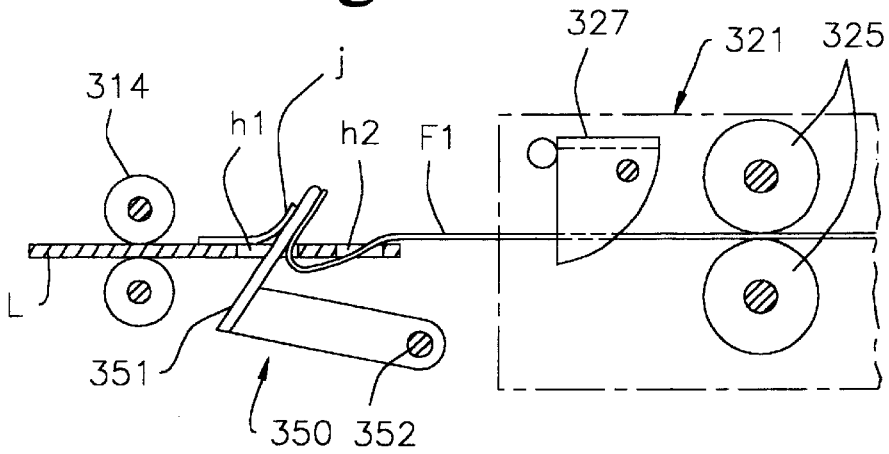
FIGS. 19A, 19B and 19C are cross sectional views illustrating the steps for uncoupling the connection between the leader sheet and the film strip and backward movement of the film strip.

FIG. 19A shows a condition where the tip of the uncoupling arm 351 is inserted into the first insert slot h1 and pushes up the front end portion of the film strip F1 to deform it upwardly. As a result, this action releases the coupling between the coupler tongue j and the coupling hole g.

Figure 19B:
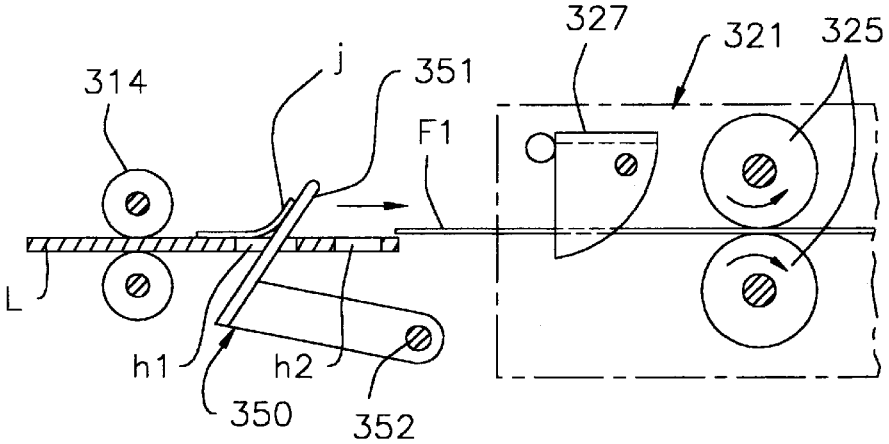

When the coupler tongue j and the coupling hole g are released from each other, the first and the second film feed rollers 325, 326 are rotated in the reverse direction as shown by arrows in FIG. 19B. This moves each front end of the film strip F1 in the reverse direction and at the same time, the uncoupling arm 351 is moved downwardly.

Figure 19C:
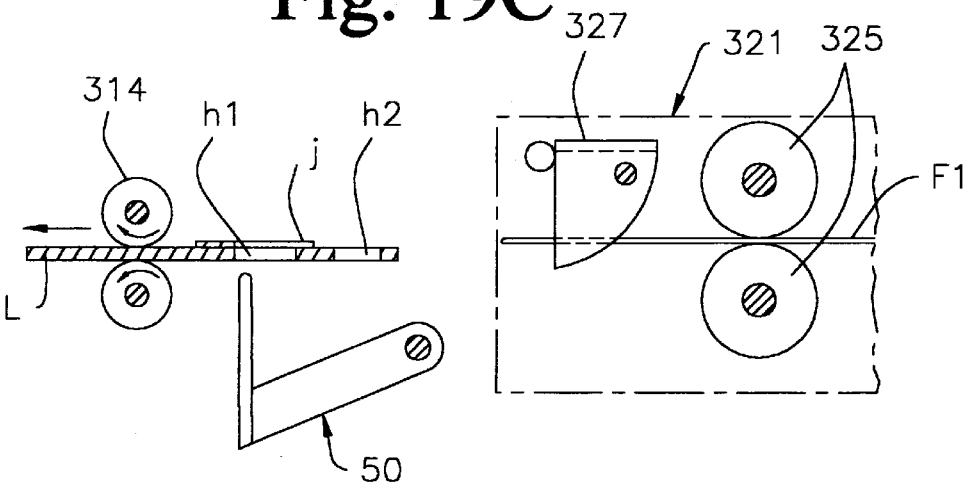

When the front end of the film strip F1 is moved back to a position shown in FIG. 19C, where the front end of the film strip F1 is within the leader sheet guide path 322 of the leader sheet guide 321, the first and the second film feed rollers 325 and 326 stop rotating.

Then, the feed rollers 314 installed in the leader sheet supporter 311 rotate to send the leader sheet L in the direction shown by the arrow in FIG. 19C.

After the first and the second film feed rollers 325 and 326 are stopped, the leader sheet guide shifter 340 is operated to move the leader sheet guide 321 along the guide rails 320. When the leader sheet guide 321 is moved to the stop position S2, the front end of the film strip F1 faces the film path 312 of the printing section 310. The leader sheet guide shifter 340 then stops and at the same time, the first film feed roller rotates to send the film strip F1 into the film path 312 of the printing section 310.

At that time, since the trailing end of the film strip F1 hangs down through the opening 329, the film strip F1 may be moved forward without adding any tension to the film strip.

Figure 20:
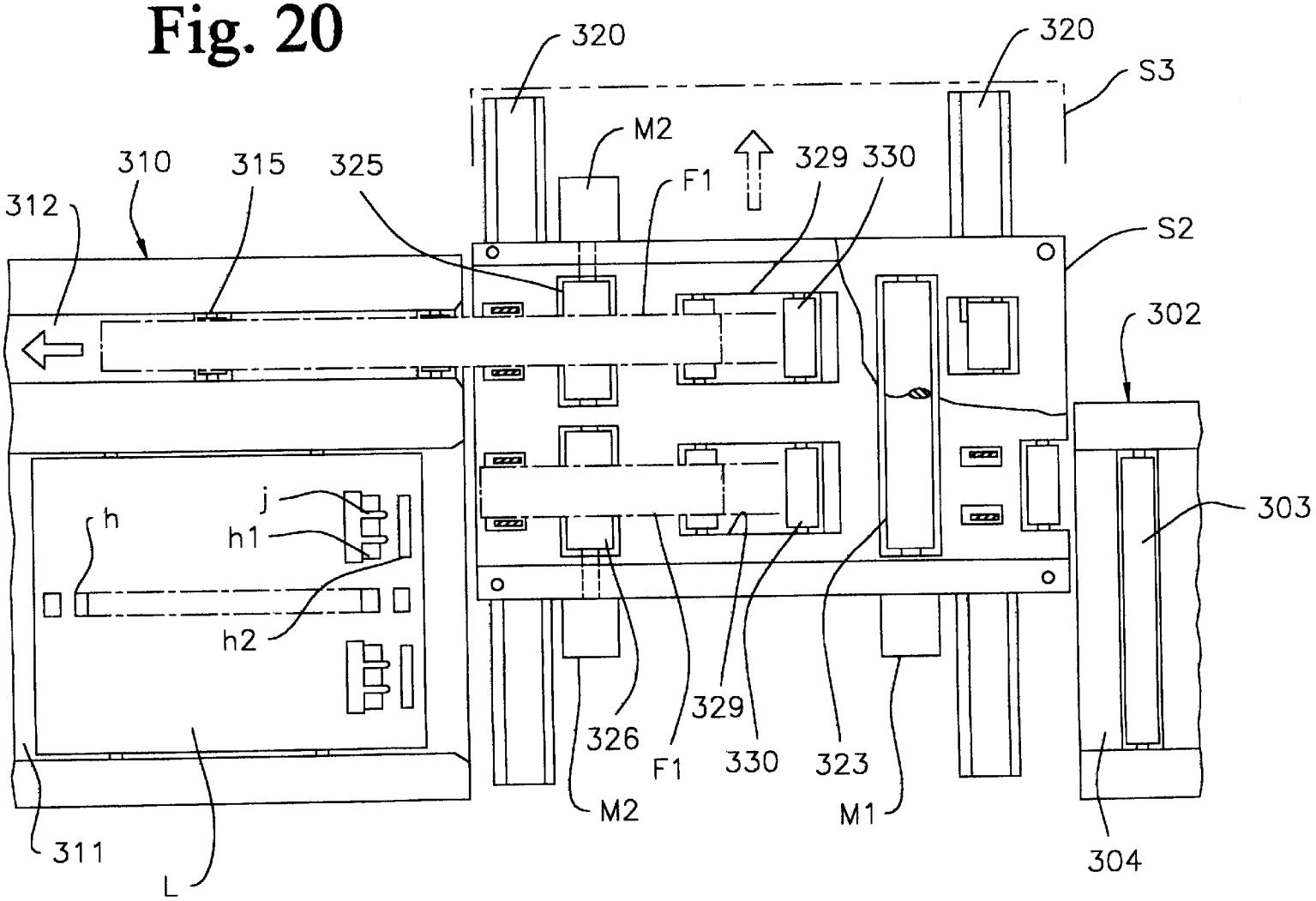
FIG. 20 is a plan view including a partial sectional view illustrating the film strip being sent into the printing section.

As shown in FIG. 20, the film strip moved into the film path 312 is further moved up to a printing position (not shown), by the rotation of a feed roller 315. When the whole film strip F1 has completely passed from the leader sheet guide 321 into the film path 312, the leader sheet guide shifter 340 is operated again to move the leader sheet guide 321 in the same direction as before.

When the leader sheet guide 321 is moved up to the stop position S3, where the front end of the remaining film strip F1 supported by the leader sheet guide 321 faces to the film path 312, the leader sheet guide shifter 340 stops. At the same time, the second film feed roller 326 rotates to send the remaining film strip F1 into the film path 312.

When the whole film strip F1 is in the film path 312, the leader sheet guide shifter 340 is operated to move the leader sheet guide 321 back up to the first stop position S1 so as to prepare for receiving the next leader sheet L sent out from the film developing section 302.

Though, in the embodiment described above, two film strips are coupled with a leader sheet, the number of the film strips is not limited two. For example, the number of film strips that may be used includes three or four.

Since the photographic film processing apparatus according to the present invention is constituted as described above, the leader sheet with two film strips coupled therewith may be sent into development processing of the film strips and then the developed film strips may be sent into the printing section continuously, so that the film strip may be processed with absolute efficiency.

It is to be understood that although the present invention has been described with regard to preferred embodiments thereof, various other embodiments and variants may occur to those skilled in the art, which are within the scope and spirit of the invention, and such other embodiments and variants are intended to be covered by the following claims.

What is claimed is:

1. A film supplying apparatus in a film developing system, comprising:

a film supplying section arranged at an entrance side of a film developing section;

a cartridge conveying device for receiving a cartridge inserted into said film supplying section and conveying the cartridge to a leader sheet coupling position;

a leader sheet supplying device for supplying a leader sheet to the leader sheet coupling position;

a splicing device for coupling a front end portion of a film strip drawn out of the cartridge with said leader sheet at the leader sheet coupling position; and a leader sheet conveying device which conveys together said leader sheet and the cartridge to said film developing section.

2. A film supplying apparatus in the film developing system as defined in claim 1, further comprising a cutting device and a punching device, wherein said cutting device includes a cutter for cutting off a tapered tongue formed on an end portion of the film strip and said punching device includes a punch for punching out coupling holes on the end portion of the film strip.

3. A film supplying apparatus in the film developing system as defined in claim 2, further comprising a tapered tongue drawing device including a mechanism for drawing out the tapered tongue formed on the end portion of a film strip from the cartridge.

4. A film supplying apparatus in a film developing system, comprising:

a film supplying section arranged at an entrance side of a film developing section;

a cartridge conveying device for receiving and intermittently conveying a cartridge inserted into said film supplying section;

a tapered tongue drawing device including a mechanism for drawing out the tapered tongue formed on an end portion of a film strip from the cartridge, said tapered tongue drawing device being located at a first stop position of said cartridge conveying device;

a cutting device and a punching device, wherein said cutting device includes a cutter for cutting off said tapered tongue and said punching device includes a punch for punching out coupling holes on the end portion of the film strip, said cutting device and said punching device being located at a second stop position of said cartridge conveying device downstream from said tapered tongue drawing device;

a label attaching device for attaching a reinforcing label on the end portion of the film strip;

a leader sheet supplying device for supplying a leader sheet to a third stop position located downstream from said label attaching device;

a splicing device structured and arranged to draw the film strip out of the cartridge, insert the film strip into an insert slot formed on the leader sheet, and engage coupler tongues formed traverse to said insert slot with the coupling holes on the film strip; and a leader sheet conveying device structured and arranged to convey the spliced leader sheet and the cartridge together to the film developing section.

5. A photographic film processing apparatus comprising:

a developing section and a printing section;

a leader sheet for conveying a film strip through said developing section;

a leader sheet guide disposed between said film developing section and said printing section;

a leader sheet guide shifter structured and arranged for moving said leader sheet guide from a position where a leader sheet guide path formed on the leader sheet guide faces an exit port of said film developing section to positions where each front end of a plurality of film strips left on said leader sheet guide path faces an entrance port of a single film path provided in said printing section;

said leader sheet guide being equipped with a leader sheet feed roller for conveying the leader sheet sent into the leader sheet guide path and the film strips following said leader sheet, and a plurality of film feed rollers each of which conveys the film strips and can be driven in forward and reverse directions; and said printing section being equipped with a uncoupling means for releasing the leader sheet and the film strip from the coupling therebetween when the leader sheet is moved out of the leader sheet guide.

6. A photographic film processing apparatus as defined in claim 5, wherein an opening is provided between the leader sheet feed roller and the film feed roller of said leader sheet guide to allow a loop to be formed on the film strip by stopping the film feed roller and rotating the leader sheet feed roller.

7. A photographic film processing apparatus as defined in claim 5, wherein said uncoupling means comprises an uncoupling arm which is installed so as to be moved upwardly and downwardly under the leader sheet in the printing section, said uncoupling arm including a tip structured and arranged so as to be inserted into a coupling hole formed in the leader sheet.

8. A photographic film processing apparatus as defined in claim 6, wherein said uncoupling means comprises an uncoupling arm which is installed so as to be moved upwardly and downwardly under the leader sheet in the printing section, said uncoupling arm including a tip structured and arranged so as to be inserted into a coupling hole formed in the leader sheet.

9. A photographic film processing apparatus comprising:

a film developing section and a film printing section; said film developing section including a film supplying section arranged at an entrance side of the film developing section;

a cartridge conveying device for receiving a cartridge inserted into said film supplying section and conveying the cartridge to a leader sheet coupling position;

a leader sheet supplying device for supplying a leader sheet to the leader sheet coupling position;

a splicing device for coupling a front end portion of a film strip drawn out of the cartridge with said leader sheet at the leader sheet coupling position;

a leader sheet conveying device which conveys together said leader sheet and the cartridge to said film developing section;

a leader sheet guide disposed between said film developing section and said printing section;

a leader sheet guide shifter structured and arranged for moving said leader sheet guide from a position where a leader sheet guide path formed on the leader sheet guide faces an exit port of said film developing section to positions where each front end of a plurality of film strips left on said leader sheet guide path faces an entrance port of a single film path provided in said printing section;

said leader sheet guide being equipped with a leader sheet feed roller for conveying the leader sheet sent into the leader sheet guide path and the film strips following said leader sheet, and a plurality of film feed rollers each of which conveys the film strips and can be driven in forward and reverse directions; and said printing section being equipped with a uncoupling means for releasing the leader sheet and the film strip from the coupling therebetween when the leader sheet is moved out of the leader sheet guide.

* * * * *